US007895846B2

(12) United States Patent
He et al.

(10) Patent No.: US 7,895,846 B2
(45) Date of Patent: Mar. 1, 2011

(54) OIL CIRCULATION OBSERVER FOR HVAC SYSTEMS

(75) Inventors: Xiang-Dong He, Belmont, MA (US); H. Harry Asada, Lincoln, MA (US); Tao Cheng, Malden, MA (US)

(73) Assignee: Massachusetts Institute of Technology, Cambridge, MA (US)

( * ) Notice: Subject to any disclaimer, the term of this patent is extended or adjusted under 35 U.S.C. 154(b) by 0 days.

(21) Appl. No.: 12/603,213

(22) Filed: Oct. 21, 2009

(65) Prior Publication Data

US 2010/0037637 A1 Feb. 18, 2010

Related U.S. Application Data

(62) Division of application No. 10/967,941, filed on Oct. 19, 2004, now abandoned.

(60) Provisional application No. 60/523,447, filed on Nov. 19, 2003.

(51) Int. Cl.
*F25B 43/02* (2006.01)

(52) U.S. Cl. ..... 62/84; 62/468

(58) Field of Classification Search ..... 62/84, 173, 62/193, 212, 468, 470, 471, 472, 473
See application file for complete search history.

(56) References Cited

U.S. PATENT DOCUMENTS 4,420,947 A 12/1983 Yoshino
4,696,167 A 9/1987 Matsui et al.
4,966,012 A 10/1990 Iida
5,170,935 A 12/1992 Federspiel et al.
5,634,345 A * 6/1997 Alsenz ..... 62/84
5,735,134 A 4/1998 Liu et al.
2005/0103035 A1 5/2005 He et al.

FOREIGN PATENT DOCUMENTS

JP 2002-257427 9/2002

OTHER PUBLICATIONS

Rice, C.K., "Benchmark Performance Analysis of an ECM-Modulated Air-to-Air Heat Pump with a Reciprocating Compressor," ASHRAE Transactions: Research, 98(1): 430-450 (1992).
He, Xiangdong, et al., "Modeling of Vapor Compression Cycles for Advanced Controls in HVAC Systems," Proceedings of the American Control Conference, pp. 3664-3668 (1995).

(Continued)

*Primary Examiner* — Melvin Jones
(74) *Attorney, Agent, or Firm* — Mills & Onello LLP

(57) ABSTRACT

An innovative oil observer for estimating oil concentration and oil amount in a refrigerant compressor in a vapor compression cycle is described. The invention ensures the safe operation of the compressor by ensuring that adequate lubricant is present in the compressor. This oil observer is based on oil models for components of air conditioning and refrigeration systems. Oil models for HVAC components estimate oil mass and refrigerant mass in each component. With all component oil models and heat exchanger observers which provide the estimation of inner geometric lengths of two-phase flow heat exchangers, a system-level oil observer is established by integrating all component models. Experimental testing has been conducted to verify the performance of this oil observer for steady state operation and dynamic processes. The invention has direct applications in residential and commercial air conditioning and refrigeration systems.

8 Claims, 23 Drawing Sheets

OTHER PUBLICATIONS

He, Xiangdong, et al., "Multivariable Feedback Design for Regulating Vapor Compression Cycles," Proceedings of the American Control Conference, pp. 4331-4335 (1995).

Lee, Jun-Pyo, et al., "An Experimental Investigation of Oil Retention Characteristics in CO2 Air-Conditioning Systems," Proceedings of the International Conference and Refrigeration and Air Conditioning Conference, IN, Purdue, Jul. 2002.

Lee, Jun-Pyo, "Experimental and Theoretical Investigation of Oil Retention in a Carbon Dioxide Air-Conditioning System," PhD Thesis, Graduate School of the University of Maryland, College Park, entire document, especially chapter 7, pp. 98-121, May 2003.

Japanese Office Action issued Sep. 1, 2009 in corresponding Japanese Patent Application No. 2004-317519.

"Oil Circulation Observer for HVAC Systems" Specification, Drawings and Prosecution History of U.S. Appl. No. 10/967,941, filed Oct. 19, 2004, by Xiang-Dong He, et al., which is stored in the United States Patent and Trademark Office (USPTO) Image File Wrapper (IFW) system.

* cited by examiner

OIL CIRCULATION OBSERVER FOR HVAC SYSTEMS

RELATED APPLICATION

This application is a divisional application of U.S. patent application Ser. No. 10/967,941, filed on Oct. 19, 2004, which is based on U.S. Provisional Application Ser. No. 60/523,447, filed on Nov. 19, 2003, the contents of which applications are incorporated herein in their entirety by reference.

BACKGROUND OF THE INVENTION

Lubricating oil in the compressor of a heating, ventilation and air conditioning (HVAC) system provides lubrication for moving parts in the compressor. Good lubrication ensures the safe operation of the compressor. For a refrigerant compressor, the oil lubricating capability decreases when the oil is mixed with liquid refrigerant. For example, this may happen when the defrost operation is turned on during the heating season, since under such conditions, the indoor fan is typically shut down, and liquid in the evaporator may not be evaporated. As a result, large amounts of liquid refrigerant may enter the compressor chamber and mix with the lubricating oil.

To quantify how much liquid refrigerant is mixed with oil in the compressor, an important index under investigation is oil concentration. For reliable operations, oil concentration needs to be above a certain level such that the viscosity of the oil/refrigerant mixture is large enough to guarantee sufficient lubrication for moving parts in the compressor.

All refrigerant compressors circulate some amount of oil through the system. It is essential that oil be returned in the system. However, in an evaporator, when superheat is large and evaporating temperature is low, oil viscosity may become high because liquid refrigerant becomes vapor in the superheat range. If vapor velocity is not sufficient to transport the oil, some oil may remain in the evaporator. Similarly, in suction lines, oil retention may be a problem if refrigerant vapor velocity is not sufficient or the refrigerant temperature is low.

For a multi-evaporator system with a vertical gas line, if the vapor velocity is not high enough, the oil cannot be pushed upward and return to the compressor. When a significant amount of oil remains in the evaporator-condenser-gas line circuit or accumulator, the oil in the compressor will be not sufficient to provide reliable lubrication.

Conventionally, the amount and concentration of oil in the compressor cannot be directly measured without special sensors. For purposes of research and development on the system, special designs can be used to place costly viscosity sensors at the bottom of the compressor to measure the viscosity of the oil/refrigerant mixture in the compressor, and oil concentration is calculated from the value of viscosity and oil temperature. Through a glass window installed at the side of compressor, the oil/refrigerant mixture liquid level can be measured. Without a viscosity sensor or a special oil concentration meter that is not available in actual application of air conditioning and refrigeration systems, the amount and concentration of oil in the compressor cannot be determined in conventional systems.

SUMMARY OF THE INVENTION

This invention provides an innovative method to determine the amount and/or the concentration of lubricant in the compressor of an HVAC system based on HVAC component oil models and heat exchanger observers.

In accordance with a first aspect, the invention is directed to an apparatus and method for monitoring a parameter related to lubricant in a first component of a vapor compression cycle system. In accordance with the invention, a parameter related to retained lubricant in a plurality of other components of the vapor compression cycle system is estimated. The estimate of the parameter related to retained lubricant in the plurality of other components is subtracted from a parameter related to a known total lubricant in the vapor compression system.

In one embodiment, the first component of the vapor compression cycle system is a compressor. The plurality of other components of the vapor compression cycle system can comprise at least one of an evaporator, an accumulator, a suction gas line, a discharge gas line, a condenser, a liquid line and a receiver. The parameter related to retained lubricant in the plurality of other components of the vapor compression cycle system can be determined using one or more parameters related to the state of each component of the vapor compression system.

In accordance with another aspect, the invention is directed to an apparatus and method for monitoring a parameter related to lubricant in a component of a vapor compression cycle system. In accordance with the invention, a parameter related to a state of the component is detected. The parameter related to lubricant in the component is estimated using the parameter related to the state of the component.

In one embodiment, the parameter related to lubricant in the component is used to determine an amount of lubricant in the component. In one embodiment, the parameter related to lubricant in the component is used to determine a concentration of lubricant in the component. In one embodiment, the component of the vapor compression cycle system is one of an evaporator, an accumulator, a suction gas line, a discharge gas line, a condenser, a liquid line and a receiver.

In accordance with another aspect, the invention is directed to an apparatus and method for monitoring a parameter related to lubricant in a heat exchanger of a vapor compression cycle system. In accordance with the invention, a length of a two-phase portion of the heat exchanger is determined. The parameter related to lubricant in the heat exchanger is estimated using the length of the two-phase portion of the heat exchanger.

In accordance with another aspect, the invention is directed to an apparatus and method for monitoring a parameter related to lubricant in a heat exchanger of a vapor compression cycle system. In accordance with the invention, a length of a single-phase portion of the heat exchanger is determined. The parameter related to lubricant in the heat exchanger is estimated using the length of the single-phase portion of the heat exchanger.

BRIEF DESCRIPTION OF THE DRAWINGS

The foregoing and other objects, features and advantages of the invention will be apparent from the more particular description of a preferred embodiment of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF PREFERRED EMBODIMENTS OF THE INVENTION

Figure 1A:
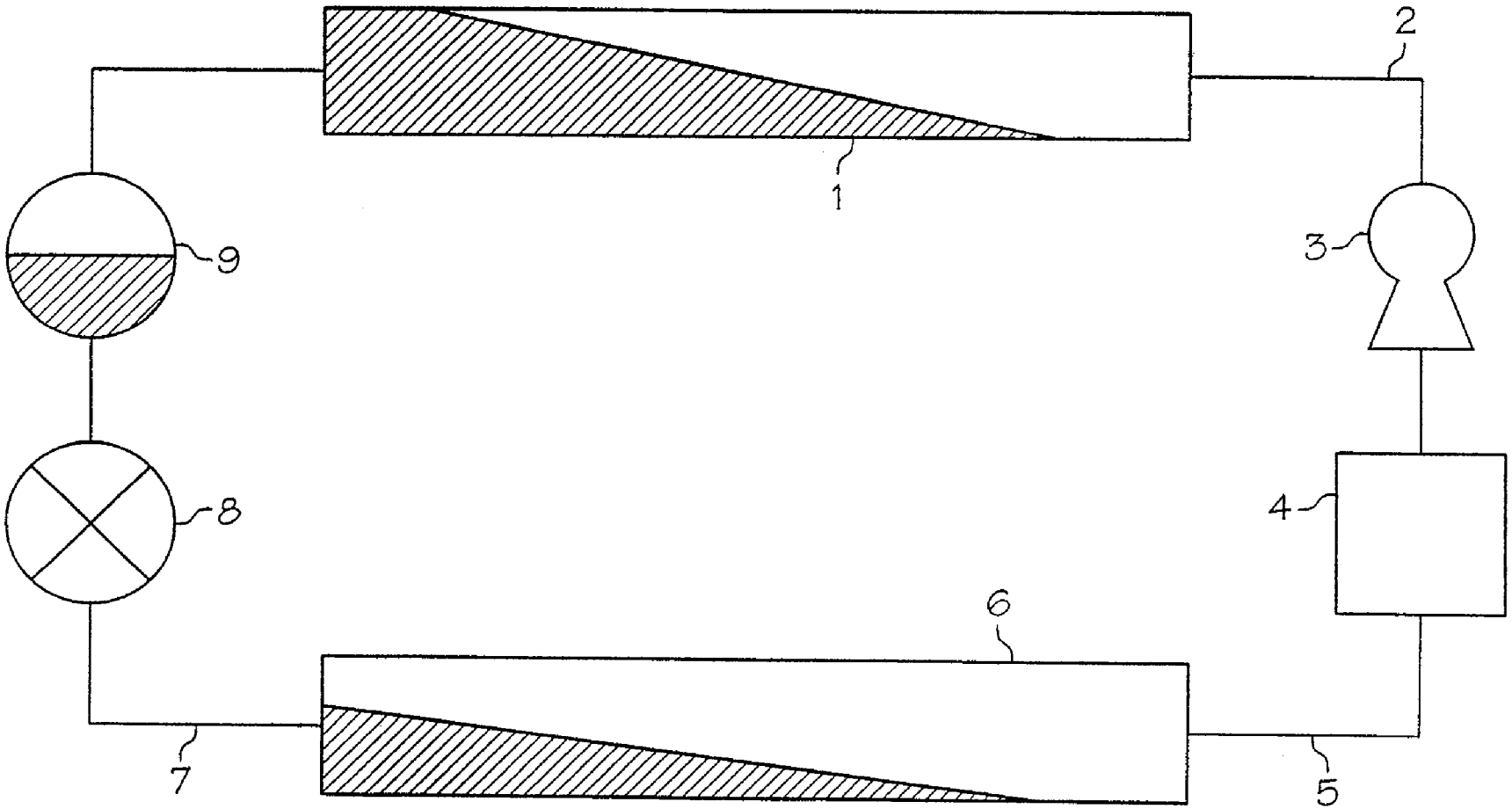
FIG. 1A contains a schematic block diagram of a vapor compression refrigeration system in accordance with one embodiment of the present invention.

FIG. 1A contains a schematic block diagram of a vapor compression refrigeration system in accordance with one embodiment of the present invention. Referring to FIG. 1A, the vapor compression system includes a condenser 1 connected to a compressor 3 via a gas discharge line 2. An accumulator 4 collects refrigerant flowing through the system and is connected to the compressor 3. An evaporator 6 is connected to the accumulator 4 via a gas suction line 5. An expansion valve 8 is connected to the evaporator 6 via a liquid line 7. A receiver 9, which receives and stores liquid refrigerant flowing through the system is connected between the condenser 1 and the expansion valve 8. It should be noted that although not shown in the drawing of FIG. 1A, the vapor compression system of the invention can also include additional components such as an oil separator, a gas cooler, an internal heat exchanger or other components. The invention is applicable to systems that include these and other components of vapor compression refrigeration systems.

In this invention, a dynamic nonlinear observer to estimate the oil concentration and the amount of oil in a refrigerant compressor is described. This oil observer is based on 1) integrated oil/refrigerant distribution and circulation model to estimate oil mass and refrigerant mass in each HVAC component, 2) heat exchanger observers to estimate the two-phase section lengths of the evaporator and condenser, and the subcool section length of the condenser, 3) mass conservation for oil and refrigerant in the whole machine. Dynamic simulation based on the oil/refrigerant model requires the initial conditions for all state variables. However, most of the initial conditions for the state variables cannot be measured by sensors. The dynamic nonlinear observer of the invention described herein can estimate unmeasured variables such as oil concentration and oil amount in the compressor using available sensor information such as evaporating temperature, condensing temperature, etc.

To synthesize an oil observer, integrated models for oil/refrigerant circulation and distribution have been developed for each main component of an air conditioning and refrigeration system. Components include evaporator, condenser, gas line, liquid line, accumulator and compressor. Oil retention and refrigerant mass in each component are estimated based on void fraction model and estimated geometry of heat exchangers such as length of two-phase section in evaporator and lengths of two-phase section and sub cooled one-phase liquid section in condenser.

There are no sensors to measure length of the two-phase section in the evaporator and the lengths of the two-phase section and sub cooled one-phase liquid section in the condenser. In accordance with the invention, a dynamic evaporator observer is used to estimate length of the two-phase section in the evaporator based on available sensor information of evaporating temperature. A dynamic condenser observer is used to estimate lengths of the two-phase section and sub cooled one-phase liquid section in the condenser based on available sensor information of condensing temperature.

This invention is applicable to reciprocating compressors, scroll compressors, rotary and swing compressors, centrifugal compressors, and screw compressors. This invention is applicable to residential air conditioners and heat pumps, commercial air conditioners and heat pumps, chillers, multi-evaporator systems, refrigerators, refrigeration systems and other types of machines working on the vapor compressor cycle principle. This invention is applicable to all combinations of miscible oil and refrigerant.

1. Oil Observer Structure

An oil observer described herein in accordance with the invention is based on oil models that will be described below in Section 2 and uses a sensor measurement such as evaporating temperature, condensing temperature, superheat, subcool, etc., to estimate the oil concentration and oil amount in the compressor, without an expensive viscosity sensor.

Figure 1B:
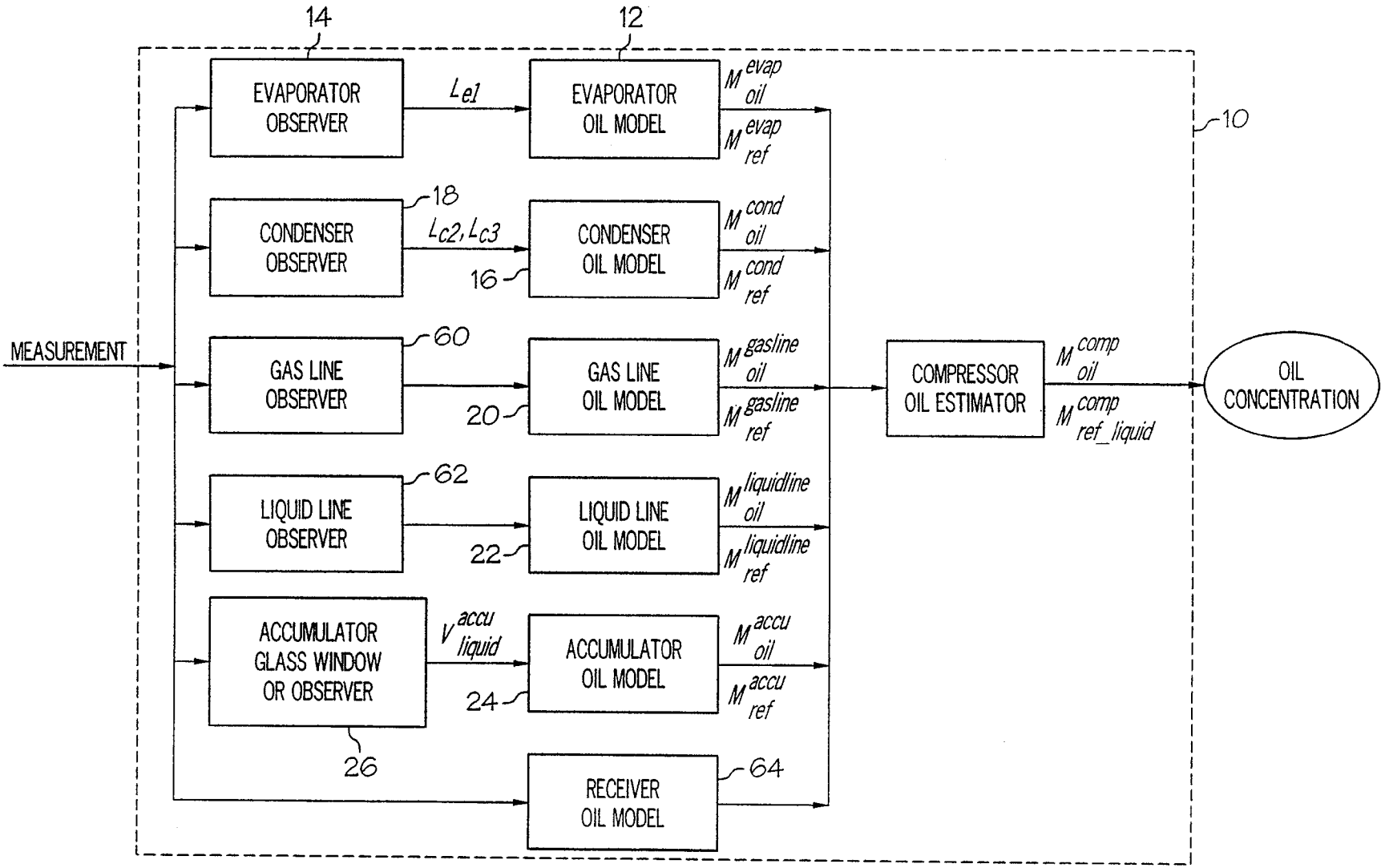
FIG. 1B contains a schematic block diagram of the overall structure of an embodiment of the oil observer in accordance with the invention.
Figure 2:
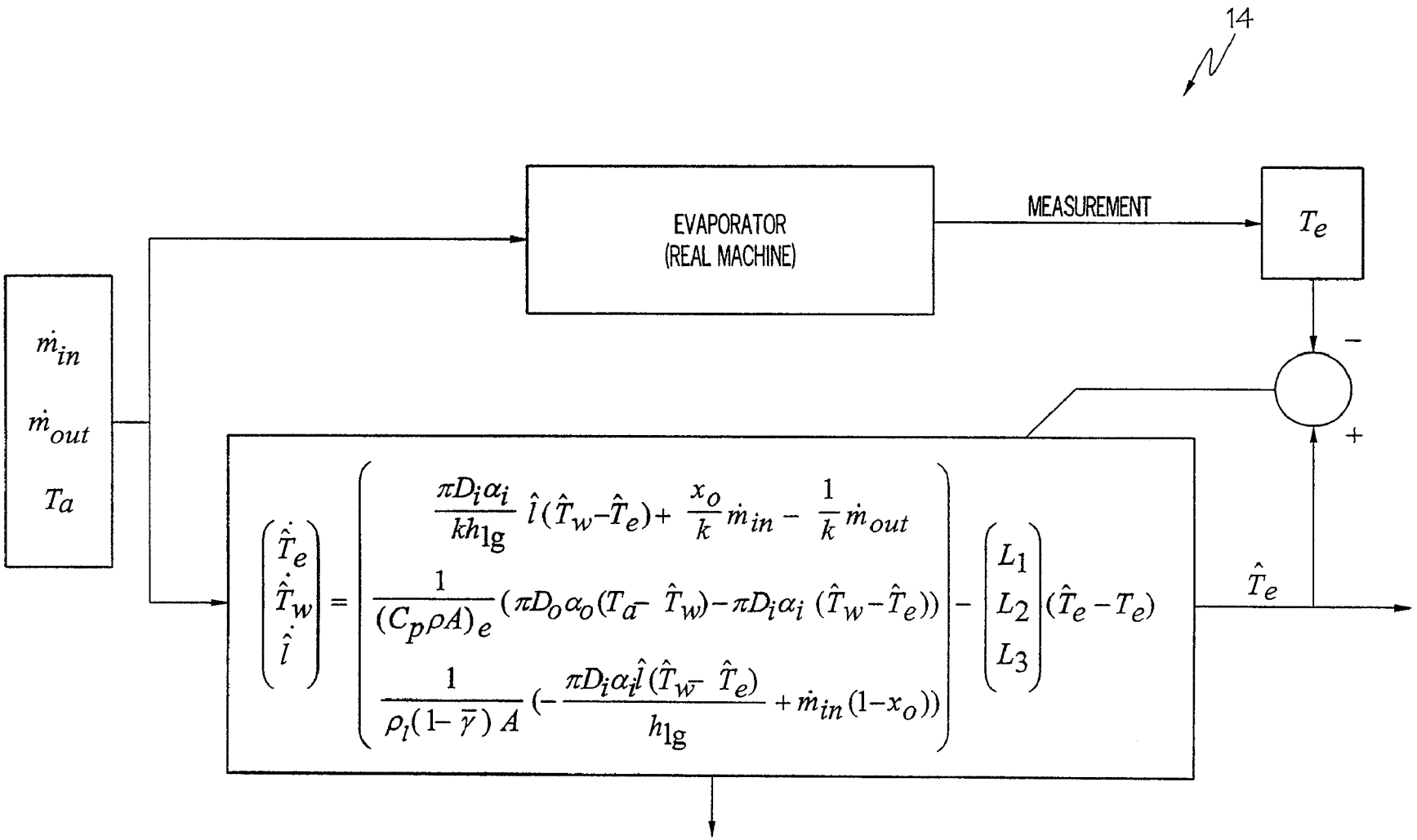
FIG. 2 contains a schematic functional block diagram of one embodiment of an evaporator observer in accordance with the invention.

FIG. 1B is a schematic block diagram of the overall structure of an embodiment of the oil observer 10 in accordance with the invention. In FIG. 1B, the evaporator oil model 12 is used to estimate oil mass and refrigerant mass in the evaporator. The two-phase length of the evaporator $Le_1$ is obtained from the evaporator observer 14, which is described in Section 4 below. The structure of the evaporator observer 14 is shown in FIG. 2, which is a schematic functional block diagram of the evaporator observer 14. The evaporator observer is a dynamic observer taking evaporating temperature Te as an input, and whose output is the two-phase length $Le_1$ (that is l in the model equation).

Figure 3:
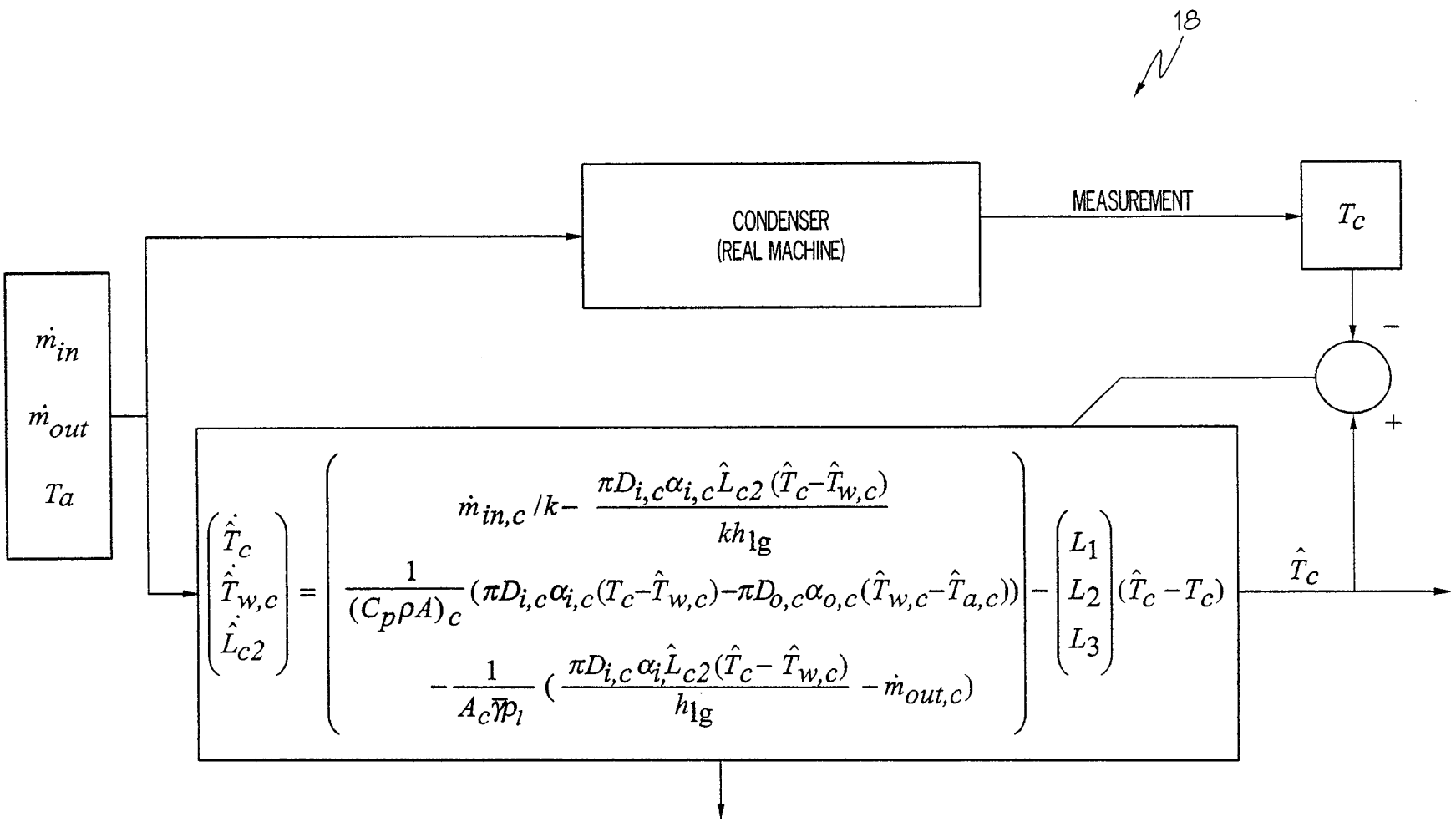
FIG. 3 contains a schematic functional block diagram of one embodiment of a condenser observer in accordance with the invention.

The condenser oil model 16 is used to estimate oil mass and refrigerant mass in the condenser. The two-phase length of the condenser $L_{c2}$ and the subcool section length $L_{c3}$ are obtained from the condenser observer 18, which is described in Section 4 below. FIG. 3 is a schematic functional block diagram of the condenser observer 18. The condenser observer 18 is a dynamic observer that is similar to the evaporator observer 14, taking condensing temperature Tc, subcool SC, etc., as input, and having two-phase length $L_{c2}$ and subcool section length $L_{c3}$ as outputs. The gas line oil model 20 is used to estimate oil mass and refrigerant mass in the gas line using parameters provided by the gas line observer 60. The liquid line oil model 22 is used to estimate oil mass and refrigerant mass in the liquid line using parameters provided by the liquid line observer 62. The accumulator oil model 24 is used to estimate oil mass and refrigerant mass in the accumulator. The accumulator oil model 24 receives input information including liquid volume in the accumulator, which is measured from the accumulator glass window or other measurement/estimation methods 26. For an air conditioning or refrigeration system without an accumulator, the accumulator oil model 24 in FIG. 1B is not used. The receiver oil model 64 is used to estimate oil mass and refrigerant mass in the receiver.

With the estimation of oil mass in the evaporator, condenser, gas line, liquid line and accumulator, the oil mass in the compressor is obtained since total oil mass in the machine is constant. With the estimation of refrigerant mass in the evaporator, condenser, gas line, liquid line and accumulator, refrigerant mass in the compressor is obtained since total refrigerant mass in the machine is constant. Furthermore, the liquid refrigerant in compressor can be estimated and then the oil concentration can be calculated based on estimated oil mass and liquid refrigerant mass in the compressor.

2. Component Oil/Refrigerant Models

In this section, models for estimating oil mass and refrigerant mass in the evaporator, the condenser, the gas line, the liquid line and the accumulator are described. To estimate the oil mass and refrigerant mass the in evaporator and condenser accurately, important factors are 1) proper void fraction model, 2) accurate volumes for one-phase subcool liquid section length in the condenser and two-phase section lengths, 3) and oil circulation rate.

2.1 Condenser Oil Model: Refrigerant and Oil Mass in Condenser

Figure 4:
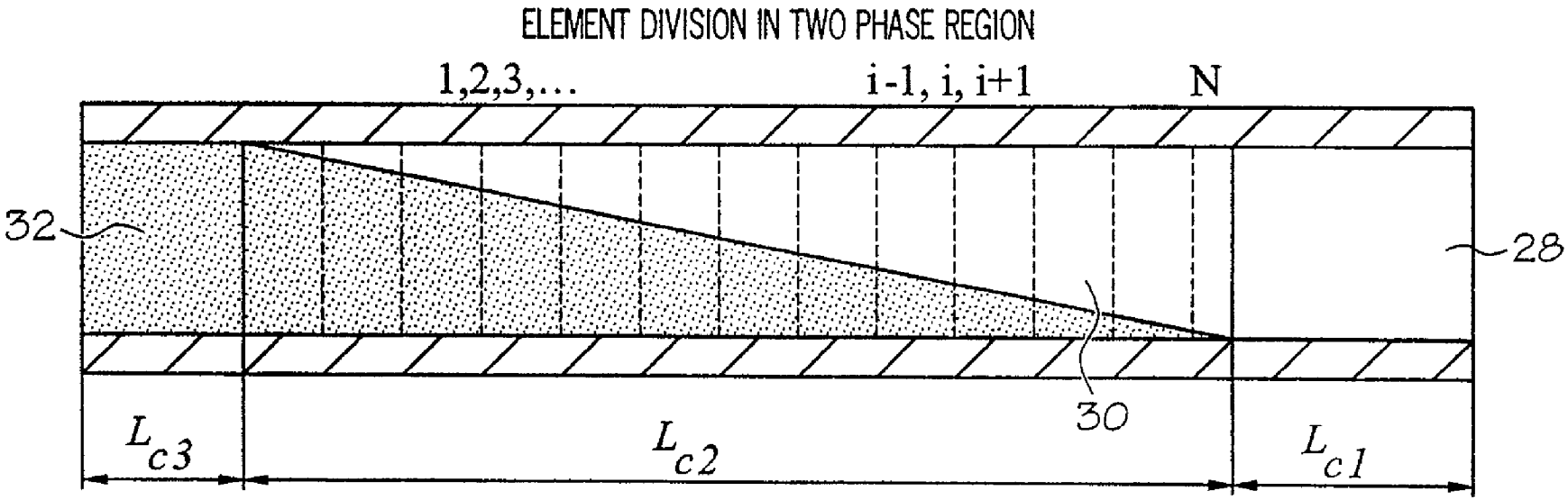
FIG. 4 contains a schematic diagram of the element model for the condenser two-phase flow region in accordance with the invention.

FIG. 4 is a schematic diagram of the element model for the condenser two-phase flow region. The condenser can be divided into three sections as shown in FIG. 4: the superheated section 28 having length $L_{c1}$, the two-phase section 30 having length $L_{c2}$ and the sub cooled section 32 having length $L_{c3}$. Lengths $Lc_2$ and $Lc_3$ are obtained from the condenser observer 18.

The two-phase section 30 of the condenser can be divided into N elements i. At i=1, the vapor quality x=0; at i=N, x=1. For a condenser, it is assumed that the heat flux from the heat exchange is constant. Then the vapor quality decreases linearly. The two-phase region is divided into N elements as shown in FIG. 4, so that within each element the thermodynamic property differences in each phase are negligible.

The length of each element is $dl_2=Lc_2/N$ and vapor quality x(i) in section i can be evaluated:

$$x(i) = \frac{i-1}{N-1} \tag{1}$$

It is assumed that $Lc_2$ is the length of two-phase section, x is the vapor quality of the oil/refrigerant mixture at a location of condenser, $C_{oil}$ is the oil circulation rate (wt %) defined as the ratio of oil mass flow rate and total oil/refrigerant mixture mass flow rate, and $\alpha$ is void fraction which can be estimated by different void fraction models. The following equations (2) through (4) are used in accordance with one embodiment of the invention to estimate mean void fraction $\alpha$ based on Hughmark's void fraction model that is dependent on mass flow rate.

$$\alpha = K_H \beta \tag{2}$$

$$\beta = \frac{x/\rho_g}{(x/\rho_g) + (1-x)/\rho_l} \tag{3}$$

where the parameter $K_H$ has been fitted to a polynomial:

$$K_H = 0.7266477 - 3.481988 \times 10^{-4} Z_k - \frac{0.845427}{Z_k} + 0.0601106 Z_k^{1/3} \tag{4}$$

while $Z_k$ depends on viscosity, averaged Reynold number Re (depending on mass flux etc.), the Froude number Fr, and the liquid volume fraction $y_L$.

$$Z_k = \frac{Re^{1/6} Fr^{1/8}}{y_L^{1/4}}$$

$$Re = \frac{DG}{\mu_l + \alpha(\mu_v - \mu_l)}$$

$$Fr = \frac{1}{gD}\left(\frac{Gx}{\beta \rho_v}\right)^2$$

$$y_L = 1 - \beta$$

where D is tube hydraulic diameter, G is refrigerant mass velocity, g is acceleration due to gravity, and $\mu_v$ is dynamic viscosity of refrigerant vapor, and $\mu_l$ is viscosity of liquid mixture.

For each element in the two-phase section 30, the void fraction is calculated based on the Hughmark's void fraction mode using the parameters in that element. For a certain element with vapor quality x and calculated void fraction value $\alpha$, the total liquid volume (liquid refrigerant+oil) in that element is $dQ_{liquid}=dV(1-\alpha)=A_c dz(1-\alpha)$. Assuming that the oil is well mixed with the liquid refrigerant, the following equation (5) is used to estimate the oil mass retention in that element.

$$dM_{oil} = dV(1-\alpha)\frac{C_{oil}}{(1-x)}\rho_{liquid} \tag{5}$$

where $\rho_{liquid}$ is the density of oil/refrigerant mixture and is calculated as follows:

$$\rho_{liquid} = \frac{\rho_{oil}}{1 + \frac{1 - x - C_{oil}}{1 - x}(\rho_{oil}/\rho_R - 1)} \tag{6}$$

where $\rho_{oil}$ is pure oil density and $\rho_R$ is density of refrigerant liquid and $$\frac{1 - x - C_{oil}}{1 - x}$$

is mass fraction of refrigerant in the oil/refrigerant mixture. The vapor refrigerant mass in that element can be obtained by:

$$dM_{ref,vapor} = dV\alpha\rho_g \tag{7}$$

The liquid refrigerant mass in that element can be obtained by:

$$dM_{ref,liquid} = dV(1 - \alpha)\frac{1 - x - C_{oil}}{1 - x}\rho_{liquid} \tag{8}$$

Then, the liquid refrigerant mass in the entire condenser can be obtained by:

$$\begin{aligned} M_{ref,liquid} &= (1 - C_{oil})A_c L_{c3}\rho_{liquid} + \\ &\int_{z=0}^{z=L_{c2}} (1 - \alpha(x(z)))\rho_{liquid}\frac{1 - x(z) - C_{oil}}{1 - x(z)} A_c dz \\ &= (1 - C_{oil})A_c L_{c3}\rho_{liquid} + \\ &\sum_{i=1}^{N} (1 - \alpha_i)\rho_{liquid}\frac{1 - x_i - C_{oil}}{1 - x_i} A_c dl_2 \end{aligned} \tag{9}$$

The vapor refrigerant mass in the condenser can be obtained by:

$$\begin{aligned} M_{ref,vapor} &= \int_{z=0}^{z=L_{c2}} \alpha(x(z))\rho_g A_c dz + \alpha_N A_c L_{c1}\rho_g \\ &= \sum_{i=1}^{N} \alpha_i \rho_g A_c dl_2 + \alpha_N A_c L_{c1}\rho_g \end{aligned} \tag{10}$$

The oil mass in the condenser can be obtained by $$\begin{aligned} M_{oil} &= A_c L_{c3}\rho_{liquid} C_{oil} + \\ &\int_{z=0}^{z=L_{c2}} (1 - \alpha(x(z)))\rho_{liquid}\frac{1 - -C_{oil}}{1 - x(z)} A_c dz + \\ &(1 - \alpha_N)A_c L_{c1}\rho_{oil} \\ &= A_c L_{c3}\rho_{liquid} C_{oil} + \\ &\sum_{i=1}^{N} (1 - \alpha_i)\rho_{liquid}\frac{1 - x_o - C_{oil}}{1 - x_i} A_c dl_2 + \\ &(1 - \alpha_N)A_c L_{c1}\rho_{oil} \end{aligned} \tag{11}$$

The total refrigerant mass in condenser is $$M_{ref} = M_{ref,vapor} + M_{ref,liquid} \tag{12}$$

The above condenser oil model obtains information including Lc2, Lc3 from the condenser observer 18, condensing temperature $T_c$, oil circulation rate $C_{oil}$, and mass flow rate for calculating void fraction. Mass flow rate can be estimated based on the compressor mass flow model. It should be noted that the length of the subcool section Lc3 is the key value for accurate estimation of refrigerant mass inventory in the condenser, since in the subcool section, all refrigerant is high quality liquid that has much higher density than vapor refrigerant density. Another important factor is the selection of void fraction model. The Hughmark model is selected in embodiment of the invention because some other models tend to underestimate the liquid mass. Generally, the condenser can hold about 40% to 48% of total refrigerant charge.

2.2 Evaporator Oil Model: Refrigerant and Oil Mass in Evaporator

Figure 5:
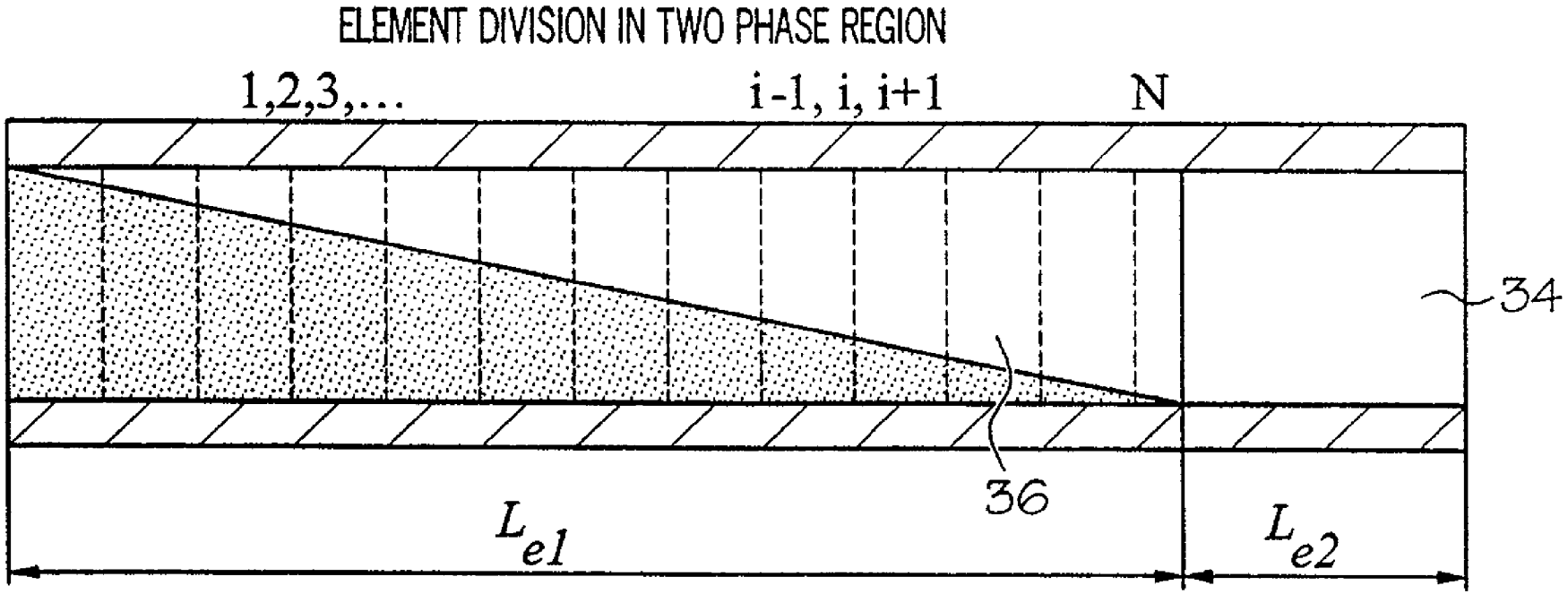
FIG. 5 contains a schematic block diagram of the element model for the evaporator two-phase flow region in accordance with the invention.

FIG. 5 is a schematic block diagram of the element model for the evaporator two-phase flow region. The evaporator can be divided to two sections as shown in FIG. 5: a superheated section 34 having length Le2, and a two-phase section 36 having length Le1. Two-phase section length $Le_1$ is obtained from evaporator observer 14. The two-phase region is divided into N elements i. At i=1, the vapor quality $x=x_0$; at i=N, $x=1-C_{oil}$. The calculation for the evaporator is similar to that of the condenser. It is assumed that the vapor quality decreases linearly. The two-phase region is divided into N elements as shown in FIG. 5, so that within each element the thermodynamic property differences in each phase are negligible.

The length of each element is $dl_1 = L_{e1}/N$, and vapor quality in section i can be evaluated:

$$x(i) = x_0 + \frac{i - 1}{N - 1}(1 - x_0) \tag{13}$$

For each element in the two-phase section, the void fraction is calculated based on the Hughmark's void fraction mode using the parameters in that element. Then, the liquid refrigerant mass in the evaporator can be obtained by:

$$\begin{aligned} M_{ref,liquid} &= \int_{z=0}^{z=Le1} (1 - \alpha(x(z)))\rho_{liquid}\frac{1 - x(z) - C_{oil}}{1 - x(z)} A_c dz \\ &= \sum_{i=1}^{N} (1 - \alpha_i)\rho_{liquid}\frac{1 - x_i - C_{oil}}{1 - x_i} A_c dl_1 \end{aligned} \tag{14}$$

The oil mass in the evaporator can be obtained by:

$$\begin{aligned} M_{oil} &= \int_{z=0}^{z=L_{e1}} (1 - \alpha(x(z)))\rho_{liquid}\frac{1 - -C_{oil}}{1 - x(z)} A_c dz + \\ &(1 - \alpha_N)A_c L_{e2}\rho_{oil} \\ &= \sum_{i=1}^{N} (1 - \alpha_i)\rho_{liquid}\frac{1 - x_o - C_{oil}}{1 - x_i} A_c dl_1 + \\ &(1 - \alpha_N)A_c L_{e2}\rho_{oil} \end{aligned} \tag{15}$$

The vapor refrigerant mass in the evaporator can be obtained by $$M_{ref,vapor} = \int_{z=0}^{z=L_{e1}} \alpha(x(z))\rho_g A_c\, dz + \alpha_N A_c L_{e2}\rho_g = \sum_{i=1}^{N} \alpha_i \rho_g A_c dl_1 + \alpha_N A_c L_{e2}\rho_g \quad (16)$$

The total refrigerant mass in evaporator is $$M_{ref}=M_{ref,vapor}+M_{ref,liquid} \quad (17)$$

The above evaporator oil model obtains information of two-phase section length $L_{e1}$ from the evaporator observer 14, evaporating temperature $T_c$, inlet vapor quality $x_0$, oil circulation rate $C_{oil}$, and mass flow rate for calculating void fraction. Generally, the evaporator can hold about 10% to 16% of total refrigerant charge.

2.3 Liquid Line Oil Model: Refrigerant and Oil Mass in Liquid Line

Figure 6:
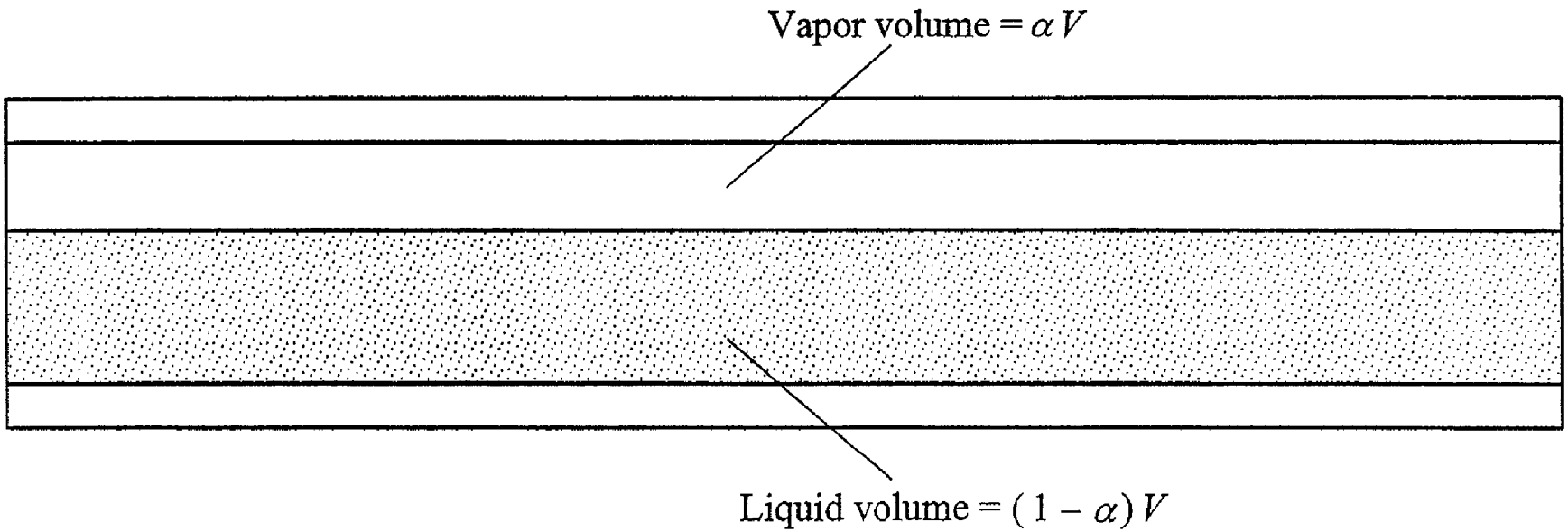
FIG. 6 contains a schematic block diagram of a liquid line in accordance with the invention.

FIG. 6 is a schematic block diagram of a liquid line. It is assumed that V is the total volume of the liquid line, x is the average vapor quality of oil/refrigerant mixture of the liquid line, and $\alpha$ is mean void fraction of the liquid line and can be estimated by different void fraction models. In accordance with the invention, the Hughmark model or the following equation is used to estimate mean void fraction $\alpha$ $$\alpha = \frac{1}{1 + \frac{1-x}{x}\left(\frac{\rho_g}{\rho_l}\right)^{2/3}}$$

where $\rho_g$ is the saturated vapor density and $\rho_l$ is the saturated liquid density When the void fraction value $\alpha$ is obtained, the total liquid volume (liquid refrigerant+oil) in the liquid line is $Q_{liquid}=V(1-\alpha)$. Assuming that the oil is well mixed with the liquid refrigerant; the following equation is used to estimate the oil mass retention in the liquid line.

$$M_{oil} = V(1-\alpha)\frac{C_{oil}}{(1-x)}\rho_{liquid} \quad (18)$$

The vapor refrigerant mass in the liquid line can be obtained by:

$$M_{ref,vapor}=\alpha V\rho_g \quad (19)$$

The liquid refrigerant mass in the liquid line can be obtained by:

$$M_{ref,liquid} = V(1-\alpha)\frac{1-x-C_{oil}}{1-x}\rho_{liquid} \quad (20)$$

2.2 Gas Line Oil Model: Refrigerant and Oil Mass in Gas Line

In the gas line, it is assumed that the void fraction is the same as the superheated section and there is no liquid refrigerant. Assuming that V is the total volume of the gas line, $\alpha$ is mean void fraction of gas line. The vapor refrigerant mass in the gas line can be obtained by:

$$M_{ref,vapor}=\alpha V\rho_g \quad (21)$$

the oil mass retention in the gas line is $$M_{oil}=V(1-\alpha)\rho_{oil} \quad (22)$$

Gas line and liquid line oil models use information of averaging vapor quality, averaging refrigerant temperature, oil circulation rate $C_{oil}$, and total mass flow rate.

2.5 Accumulator Oil Model: Refrigerant and Oil Mass in Accumulator

Assuming that $T_r$ is refrigerant temperature in accumulator, the saturated liquid density $\rho_l$ and saturated vapor density $\rho_g$ can be determined from $T_r$ based on thermodynamics properties. Oil density $\rho_{oil}$ is a function of $T_r$. It is assumed that the total volume of accumulator is V, and the liquid volume $V_L$ can be calculated based on liquid level measurement through the glass window at the side of accumulator.

The vapor refrigerant mass in the accumulator can be obtained by:

$$M_{ref,vapor}=(V-V_L)\rho_g \quad (23)$$

The oil mass in the accumulator is $$M_{oil}=V_L\rho\omega_{oil} \quad (24)$$

where $\rho$ is the density of oil/liquid refrigerant mixture and is expressed by $$\rho = \frac{\rho_{oil}}{1+(1-\omega_{oil})(\rho_{oil}/\rho_R - 1)} \quad (25)$$

and $\omega_{oil}$ is the oil concentration of oil/liquid refrigerant mixture in accumulator.

The liquid refrigerant mass in the accumulator can be obtained by:

$$M_{ref,liquid}=V_L\rho(1-\omega_{oil}) \quad (26)$$

3. Oil Observer for Estimation of Oil Concentration and Oil Mass in Compressor

In Section 2 above, models to estimate oil mass and refrigerant mass in condenser, evaporator, gas line, liquid line and accumulator were described. In this section, estimation of the oil mass and refrigerant mass in the compressor based on the conservation of oil and refrigerant mass inside the machine is described. Oil concentration in the compressor can be derived in accordance with the following.

Oil mass conservation for the entire machine is $$M^{cir}_{oil}+M^{accu}_{oil}+M^{comp}_{oil}=M^{total}_{oil}$$

where $M^{total}_{oil}$ is the total oil mass charged into the machine and has a known value, $M^{cir}_{oil}=M^{evap}_{oil}+M^{cond}_{oil}+M^{gas_line}_{oil}+M^{liquid_line}_{oil}$ is the total oil retention in the refrigerant circuit including the condenser, evaporator, gas line and liquid line. $M^{accu}_{oil}$ is the oil retention in the accumulator. If there is no accumulator in a machine, this value is zero. $M^{cir}_{oil}$ and $M^{accu}_{oil}$ are estimated based on oil models described in Section 2 above.

Based on oil mass conservation, the estimated oil mass in the compressor $\hat{M}^{comp}_{oil}$ from the oil observer shown in FIG. 1B can be expressed by $$\hat{M}^{comp}_{oil}=M^{total}_{oil}-M^{cir}_{oil}-M^{accu}_{oil} \quad (27)$$

Refrigerant mass conservation for the entire machine is $$M^{cir}_{ref}+M^{accu}_{ref}+M^{comp}_{ref}=M^{total}_{ref}$$

where $M^{total}_{ref}$ is the total refrigerant mass charged into the machine and has a known value, $M^{cir}_{ref}$ is the total refrigerant mass inventory in the refrigerant circuit including the condenser, evaporator, gas line and liquid line. $M^{accu}_{ref}$ is the refrigerant mass in the accumulator. If there is no accumulator in a machine, this value is zero. $M^{cir}_{ref}$ and $M^{accu}_{ref}$ are estimated based on models described in Section 2 above.

Based on refrigerant mass conservation, the estimated refrigerant mass in the compressor $\hat{M}^{comp}_{ref}$ from the oil observer shown in FIG. 1B can be expressed by $$\hat{M}^{comp}_{ref}=M^{total}_{ref}-M^{cir}_{ref}-M^{accu}_{ref} \tag{28}$$

In order to estimate the oil concentration in the compressor, the liquid refrigerant mass in compressor is estimated. With the estimation of $\hat{M}^{comp}_{ref}$ from Equation (28), the liquid refrigerant mass $\hat{M}^{comp}_{ref,Liquid}$ is equal to $$\hat{M}^{comp}_{ref,Liquid}=\hat{M}^{comp}_{ref}-\rho_g(V^{comp}-V^{comp}_{Liquid}) \tag{29}$$

where the second term of Equation (29) is vapor refrigerant mass in the compressor, $\rho_g$ is the density of vapor refrigerant in the compressor, $V^{comp}$ is the total compressor volume where refrigerant presents, $V^{comp}_{Liquid}$ is the liquid volume of oil/liquid refrigerant mixture and can be determined by the measurement of liquid level at the glass window of the compressor.

Based on the estimated oil mass from Equation (27) and the estimated liquid refrigerant mass from Equation (29), the estimated oil concentration in the compressor can be expressed by $$w^{comp}_{oil}=\frac{\hat{M}^{comp}_{oil}}{\hat{M}^{comp}_{oil}+\hat{M}^{comp}_{ref,Liquid}} \tag{30}$$

In one embodiment, the invention is achieve 20% estimation error for oil concentration, that is $$\left|\frac{w^{comp}_{oil}-w^{sensor}_{oil}}{w^{sensor}_{oil}}\right|*100\%<20\% \tag{31}$$

where $w^{sensor}_{oil}$ is experimental oil concentration that is correlated from measurement of viscosity by a viscosity sensor installed at the bottom of the compressor.

4. Heat Exchanger Observers 4.1 Model-Based Nonlinear Observers for Evaporator

Figure 7:
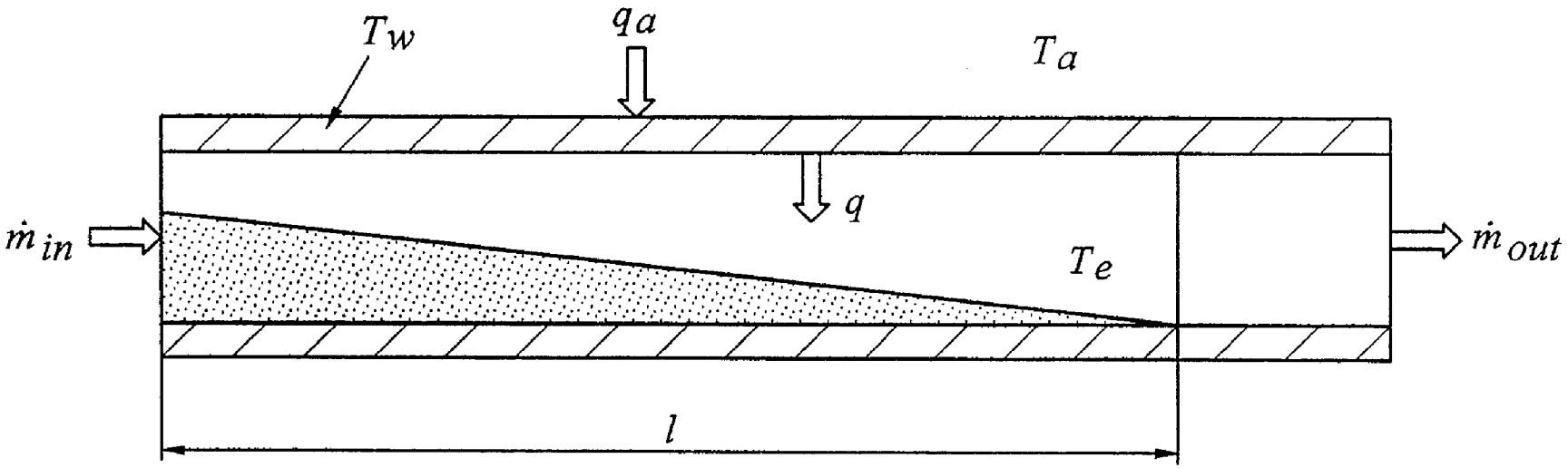
FIG. 7 contains a schematic diagram of a low-order evaporator model in accordance with the invention.

FIG. 7 contains a schematic diagram of the low-order evaporator model in accordance with the invention. $T_e$ is the evaporating temperature. l is the length of the two-phase section. $T_w$ is the wall temperature of the tube. $T_a$ is the room air temperature. $\dot{m}_{in}$ and $\dot{m}_{out}$ are the inlet and outlet refrigerant mass flow rates, respectively. q is the heat transfer rate from the tube wall to the two-phase refrigerant. $q_a$ is the heat transfer rate from the room to the tube wall.

Assuming a uniform temperature throughout the evaporator tube wall, the heat transfer equation of the tube wall is as follows:

$$(c_p\rho A)_e\frac{dT_w}{dt}=\pi D_o\alpha_o(T_a-T_w)-\pi D_i\alpha_i(T_w-T_e) \tag{32}$$

The first term on the right hand side represents the heat transfer rate per unit length from the room to the tube wall. The second term represents the heat transfer rate per unit length from the tube wall to the two-phase refrigerant.

Assuming the mean void fraction $\bar{\gamma}$ is invariant, the liquid mass balance equation in the two-phase section of the evaporator is $$\rho_l(1-\bar{\gamma})A\frac{dl(t)}{dt}=-\frac{q}{h_{lg}}+\dot{m}_{in}(1-x_0) \tag{33}$$

In equation (33), the left hand side is the liquid mass change rate in the evaporator. On the right hand side, $q/h_{1g}$ represents the rate of liquid evaporating into vapor, and $\dot{m}_{in}(1-x_0)$ is the inlet liquid mass flow rate.

The inlet refrigerant mass flow rate $\dot{m}_{in}$ is dependent on the expansion valve opening $A_v$, the low pressure $P_e$ and high pressure $P_c$, and can be expressed by $$\dot{m}_{in}=A_v^a g_v(P_e,P_c) \tag{34}$$

where a and $g_v(P_e, P_c)$ can be identified for a given expansion valve. $P_e$ and $P_c$ can be measured by two pressure sensors. For the two-phase section, the pressure is an invariant function of the temperature. Therefore, the inlet refrigerant mass flow rate $\dot{m}_{in}$ can be expressed as $$\dot{m}_{in}=A_v^a g_v(T_e,T_c) \tag{35}$$

Assuming that the vapor volume is much larger than the liquid volume in the low-pressure side, the vapor mass balance equation in an evaporator is:

$$\frac{dM_v}{dt}=V\frac{d\rho_g(T_e)}{dT_e}\frac{dT_e}{dt}=\dot{m}_{in}x_o+\frac{q}{h_{lg}}-\dot{m}_{out} \tag{36}$$

where $M_v$ is the total vapor mass and V is the total volume of the low-pressure side. $h_g-h_l=h_{1g}$, where $h_l$ and $h_g$ are refrigerant saturated liquid and vapor specific enthalpies. The outlet refrigerant mass flow rate is the same with the compressor mass flow rate which is dependent on the compressor speed, the low pressure $P_e$ and high pressure $P_c$, and can be expressed by $$\dot{m}_{out}=\omega g(P_e,P_c) \tag{37}$$

where $g(P_e, P_c)$ can be identified for a given compressor. As described above, the pressure is an invariant function of the temperature for the two-phase section. Therefore, the outlet refrigerant mass flow rate can be expressed as $$\dot{m}_{out}=\omega g(T_e,T_c) \tag{38}$$

Equation (36) can be written as $$\frac{dT_e}{dt}=\frac{\pi D_i\alpha_i}{kh_{lg}}l(T_w-T_e)+\frac{x_o}{k}\dot{m}_{in}-\frac{1}{k}\dot{m}_{out} \tag{39}$$

where $$k=V\frac{d\rho_g(T_e)}{dT_e}.$$

Based on equations (32), (33) and (39), the state space representation for the low order evaporator model is as follows, where $T_e$, l and $T_w$ are the three states of the model.

$$\begin{pmatrix}\dot{T}_e\\ \dot{T}_w\\ \dot{l}\end{pmatrix}=\begin{pmatrix}\frac{\pi D_i\alpha_i}{kh_{lg}}l(T_w-T_e)+\frac{x_o}{k}\dot{m}_{in}-\frac{1}{k}\dot{m}_{out}\\ \frac{1}{(C_p\rho A)_e}(\pi D_o\alpha_o(T_a-T_w)-\pi D_i\alpha_i(T_w-T_e))\\ \frac{1}{\rho_l(1-\bar{\gamma})A}\left(-\frac{\pi D_i\alpha_i l(T_w-T_e)}{h_{lg}}+\dot{m}_{in}(1-x_o)\right)\end{pmatrix} \tag{40}$$

Where $T_a$, $\dot{m}_{in}$ and $\dot{m}_{out}$ are the inputs to the system.

Since only $T_e$ can be easily measured using a thermocouple, an observer in accordance with the invention is used in estimating the value of l, the length of two-phase section of the evaporator.

The following are the dynamics of the non-linear observer described herein.

$$\begin{pmatrix} \dot{\hat{T}}_e \\ \dot{\hat{T}}_w \\ \dot{\hat{l}} \end{pmatrix} = \begin{pmatrix} \frac{\pi D_i \alpha_i}{k h_{lg}} \hat{l}(\hat{T}_w - \hat{T}_e) + \frac{x_o}{k}\dot{m}_{in} - \frac{1}{k}\dot{m}_{out} \\ \frac{1}{(C_p \rho A)_e}\left(\pi D_o \alpha_o (T_a - \hat{T}_w) - \pi D_i \alpha_i (\hat{T}_w - \hat{T}_e)\right) \\ \frac{1}{\rho_l (1-\bar{\gamma}) A}\left(-\frac{\pi D_i \alpha_i \hat{l}(\hat{T}_w - \hat{T}_e)}{h_{lg}} + \dot{m}_{in}(1 - x_o)\right) \end{pmatrix} - \begin{pmatrix} L_1 \\ L_2 \\ L_3 \end{pmatrix}(\hat{T}_e - T_e) \tag{41}$$

where $L_1$, $L_2$, and $L_3$ are observer gains. For the observer, the contraction theory is used in accordance with the invention to ensure that the estimated state variables will converge to the actual states in the plant The contraction theory states that the system $\dot{x}=f(x,t)$ is said to be contracting if $\partial f/\partial x$ is uniformly negative definite. All system trajectories then converge exponentially to a single trajectory, with convergence rate $|\lambda_{max}|$, where $\lambda_{max}$ is the largest eigenvalue of the symmetric part of $\partial f/\partial x$. Therefore, if we can make sure the actual states are particular solutions of the observer and the observer is contracting, then we can conclude that all the trajectories of the observer will converge to the particular solutions that are the actual states.

From the observer dynamics, if $\hat{T}_e$ is equal to $T_e$, the observer dynamics are the same with the system dynamics. So the actual states that are the solutions of this set of equations are particular solutions of the observer. If the symmetric part of the Jacobian matrix of the observer dynamics is uniformly negative definite, then the trajectory of the observer dynamics will converge to the particular solution which means the observed states are the same as the actual states.

4.2 Model-Based Nonlinear Observers for Condenser

In the oil observer described in Section 1 above, the length of two-phase and length of subcooled liquid section of a condenser are used to estimate the oil in the condenser, since the oil calculation models are different for different phase sections.

Figure 8:
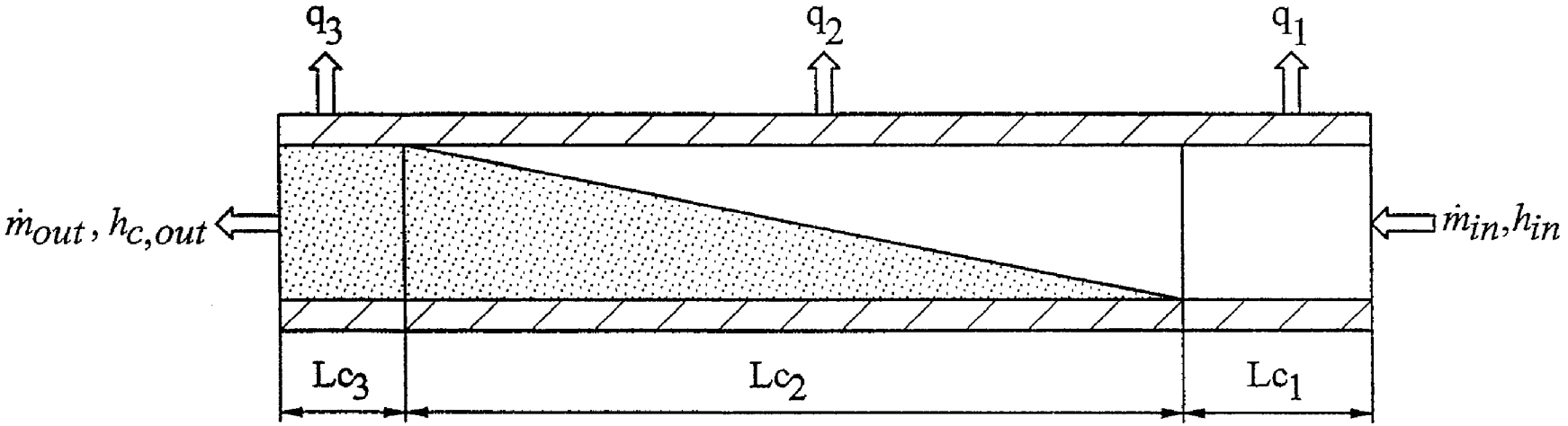
FIG. 8 contains a schematic diagram of a low-order condenser model in accordance with the invention.

In this section, the model of the condenser is described. The condenser model is similar to the evaporator model. FIG. 8 contains a schematic diagram of a low-order condenser model in accordance with the invention.

The vapor balance equation is as follows $$\frac{dM_{v,c}}{dt} = V_c \frac{d\rho_g(T_c)}{dT_c}\frac{dT_c}{dt} = \dot{m}_{in,c} - \frac{\pi D_{i,c}\alpha_{i,c}L_{c2}(T_c - T_{w,c})}{h_{lg}} \tag{42}$$

where $T_c$ is the condensing temperature, $L_{c2}$ is the two phase length and $T_{w,c}$ is the wall temperature of the condenser.

The heat transfer equation is as follows:

$$(c_p \rho A)_c \frac{dT_{w,c}}{dt} = \pi D_{i,c}\alpha_{i,c}(T_c - T_{w,c}) - \pi D_{o,c}\alpha_{o,c}(T_{w,c} - T_{a,c}) \tag{43}$$

where $T_{a,c}$ is the outdoor air temperature.

The liquid mass balance equation in the condenser model is expressed in equation (44). It is a little bit different from the evaporator model. Two sections have liquid refrigerant. One is the liquid phase section, the other is the two-phase section.

$$A_c(1-\bar{\gamma})\rho_l \frac{dL_{c2}}{dt} + A_c\rho_l\frac{dL_{c3}}{dt} = \frac{\pi D_{i,c}\alpha_{i,c}L_{c2}(T_c - T_{w,c})}{h_{lg}} - \dot{m}_{out,c} \tag{44}$$

where $L_{c3}$ is the subcool liquid phase length.

It can be seen that there are four unknowns but three equations. One of the unknowns is eliminated for the observer design. One assumption made is that the length change of the superheated phase is very slow $$\frac{dL_{c1}}{dt} \approx 0.$$

We have $$\begin{aligned} A_c(1-\bar{\gamma})\rho_l\frac{dL_{c2}}{dt} + A_c\rho_l\frac{d(L - L_{c1} - L_{c2})}{dt} &= \\ A_c(1-\bar{\gamma})\rho_l\frac{dL_{c2}}{dt} - A_c\rho_l\frac{dL_{c2}}{dt} &= \\ -A_c\bar{\gamma}\rho_l\frac{dL_{c2}}{dt} &= \frac{\pi D_{i,c}\alpha_{i,c}L_{c2}(T_c - T_{w,c})}{h_{lg}} - \dot{m}_{out,c} \\ L_{c3} = L - L_{c1} - L_{c2} \end{aligned} \tag{45}$$

Therefore the liquid mass balance equation can be written as $$\frac{dL_{c2}}{dt} = -\frac{\pi D_{i,c}\alpha_{i,c}L_{c2}(T_c - T_{w,c})}{A_c\bar{\gamma}\rho_l h_{lg}} \tag{46}$$

Equations (42), (43) and (44) are the condenser model. The model-based observer for the condenser is described as follows $$\begin{pmatrix} \dot{\hat{T}}_c \\ \dot{\hat{T}}_{w,c} \\ \dot{\hat{L}}_{c2} \end{pmatrix} = \begin{pmatrix} \dot{m}_{in,c}/k - \frac{\pi D_{i,c}\alpha_{i,c}\hat{L}_{c2}(\hat{T}_c - \hat{T}_{w,c})}{k h_{lg}} \\ \frac{1}{(C_p\rho A)_c}\left(\pi D_{i,c}\alpha_{i,c}(\hat{T}_c - \hat{T}_{w,c}) - \pi D_{o,c}\alpha_{o,c}(\hat{T}_{w,c} - \hat{T}_{a,c})\right) - \\ \frac{1}{A_c\bar{\gamma}\rho_l}\left(\frac{\pi D_{i,c}\alpha_{i,c}\hat{L}_{c2}(\hat{T}_c - \hat{T}_{w,c})}{h_{lg}} - \dot{m}_{out,c}\right) \end{pmatrix} - \begin{pmatrix} L_1 \\ L_2 \\ L_3 \end{pmatrix}(\hat{T}_c - T_c) \tag{47}$$

where $L_1$, $L_2$, and $L_3$ are observer gains.

The length of the superheated portion of the evaporator can be calculated by subtracting the length of the two-phase portion of the evaporator from its total length. With regard to the condenser, the length of the superheated portion of the condenser can be calculated by subtracting the length of its two-phase and subcool portions from its total length.

4.3 Gas Line Observer and Liquid Line Observer

During system start-up, steady state and other transient operations, if the refrigerant at the exit of the evaporator is at the two-phase state, the gas line is filled with two-phase flow. When the refrigerant at the exit of the evaporator is superheated vapor, the gas line is filled with superheated vapor flow. The gas line observer is used to detect whether the refrigerant in the gas line is at two-phase state or superheated state based on the length of the two-phase section of the evaporator. If the length of the two-phase section of the evaporator is smaller than the total length of the evaporator, then the gas line observer will indicate that the gas line is filled with superheated vapor, and the oil mass and refrigeration mass in the gas line will be estimated accordingly. If the length of the two-phase section of the evaporator is equal to the total length of the evaporator, the gas line observer will indicate that the refrigerant in the gas line is at the two-phase refrigerant state, and the oil mass and refrigeration mass in the gas line will be estimated accordingly.

During the start up, steady state and other transient operations, if the refrigerant at the exit of the condenser is at the two-phase state or the subcooled liquid state, the liquid line is filled with two-phase flow. When the refrigerant at the exit of the condenser is superheated vapor, the liquid line is filled with superheated vapor flow. The liquid line observer is used to detect whether the refrigerant in the liquid line is at the two-phase state or the superheated state based on the length of the superheated vapor section of the condenser. If the length of the superheated vapor section of the condenser equals the total length of the condenser, then liquid line observer will indicate that the liquid line is filled with superheated vapor, and the oil mass and refrigeration mass in the liquid line will be estimated accordingly. Otherwise, the length of superheated vapor section of the condenser is smaller than the total length of the condenser, and the liquid line observer will indicate that the refrigerant in the liquid line is at the two-phase refrigerant state, and the oil mass and refrigeration mass in the liquid line will be estimated accordingly.

5. Experimental Comparison

In order to verify the oil observer and oil models described herein, experimental testing has been conducted. The comparison results show the error for estimation of oil concentration in accordance with the invention is less than 20%.

5.1 Experimental Set-Up

The machine under testing was a split type residential air conditioner. The refrigerant used in this machine is R410A. The total refrigerant charge is 900 g. The lubricating oil is FVC50K, and 400 ml of oil was charged into the machine (about 370 g). The cooling capacity of the machine is 2.8 kW. All sensors (temperature, pressure, and two mass flow meters, viscosity sensor) are all connected to National Instrument data acquisition board and then connected to a PC.

5.2 Experimental Testing

Experimental testing was done for several dynamic processes such as change of outdoor temperature by removing several insulation boards of the container, change of compressor speed, and change of expansion valve opening, etc. Experimental data for dynamic process with the outdoor temperature change from 35 C to 27 C is described in details in this sub-section, and the comparison for oil concentration in the compressor described in the following sub-section is based on this testing.

Figure 9:
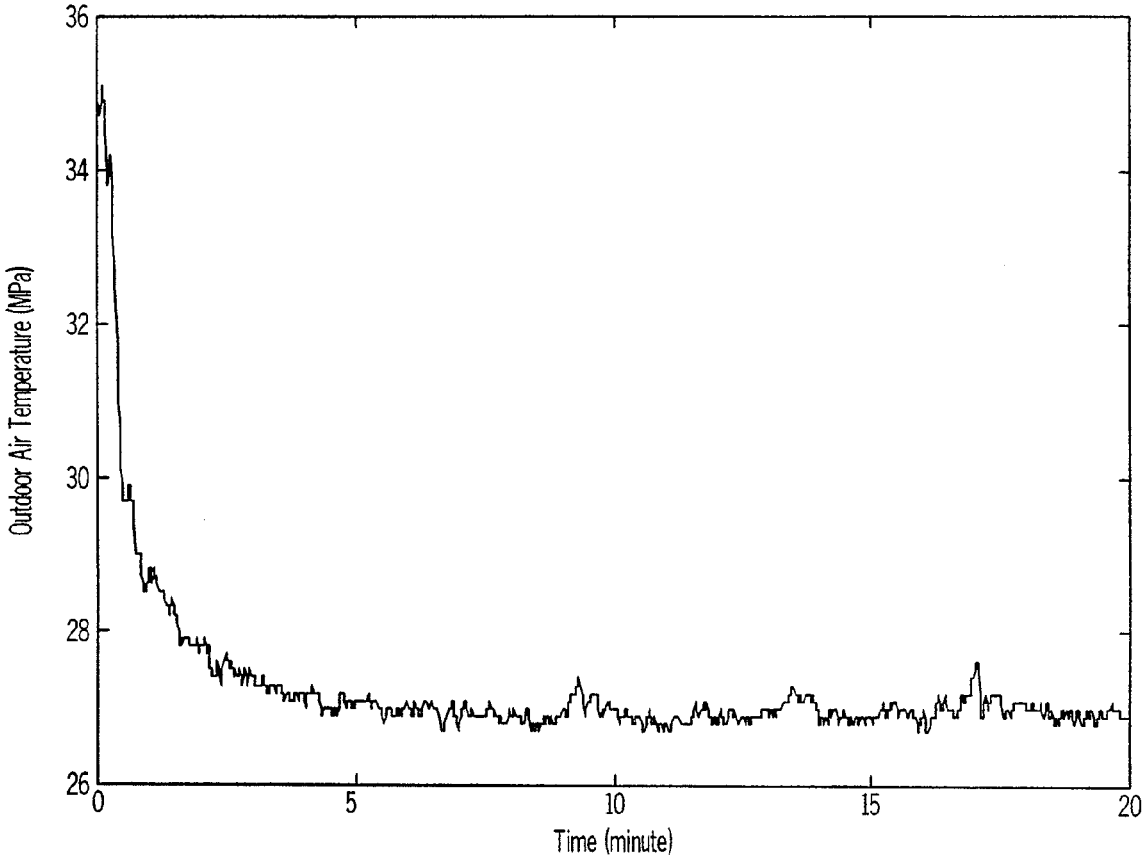
FIG. 9 contains a graph of the outdoor air temperature profile over time for an experiment performed in accordance with the invention.

After the start-up and running of the testing machine for more than 30 minutes, the operation is almost steady state. The operation condition is as follows:

1) Outdoor temperature: 35 C
2) Indoor temperature: 20 C
3) Compressor Speed: 70 Hz
4) Expansion Valve: 15 Steps
5) Indoor fan speed: 1250 rpm
6) Outdoor fan speed: 630 rpm The outdoor temperature is changed from 35 C to 27 C and then the system is allowed to reach another steady state as shown in FIG. 9, which is a graph of the outdoor air temperature profile over time for the experiment.

Figure 10:
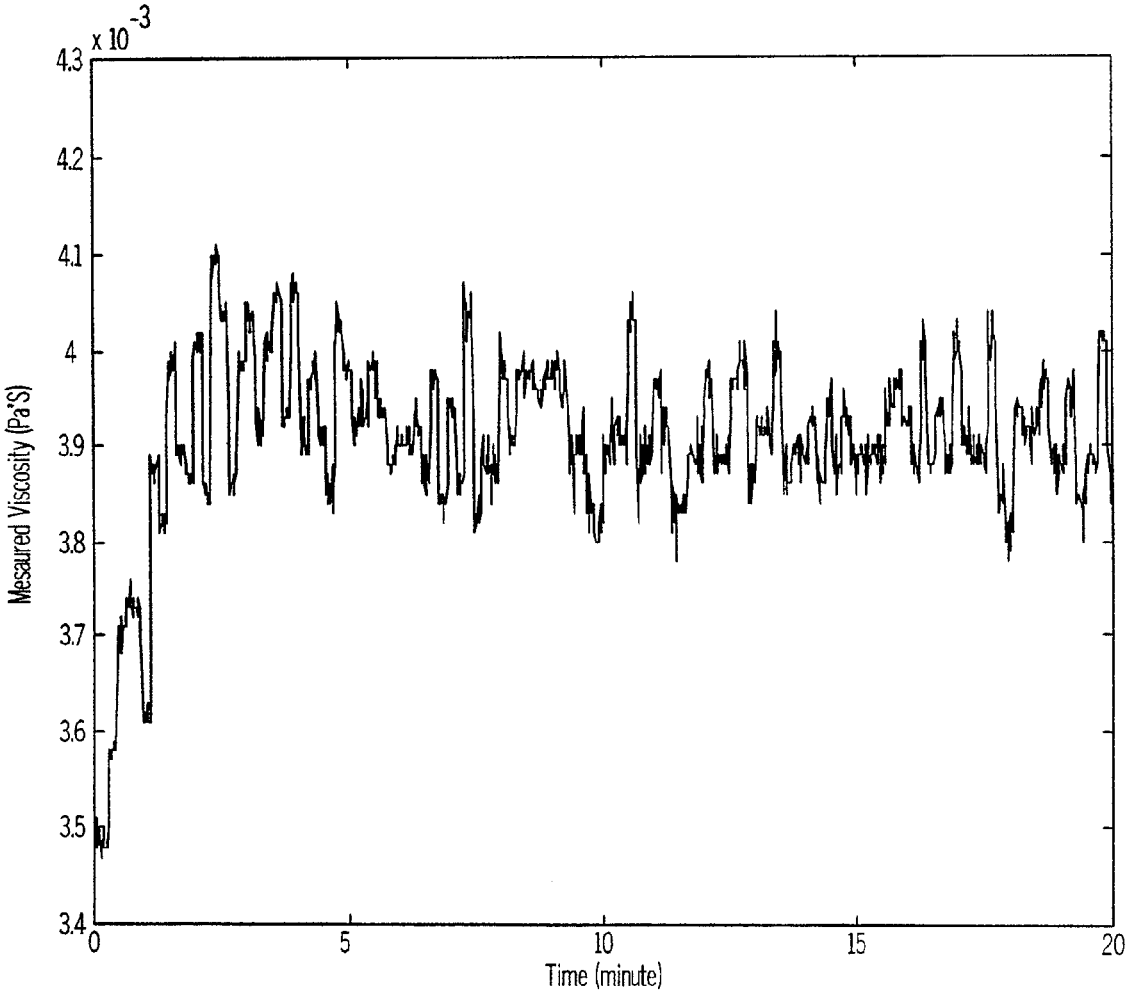
FIG. 10 contains a graph of the compressor oil viscosity profile over time for the experiment.
Figure 11:
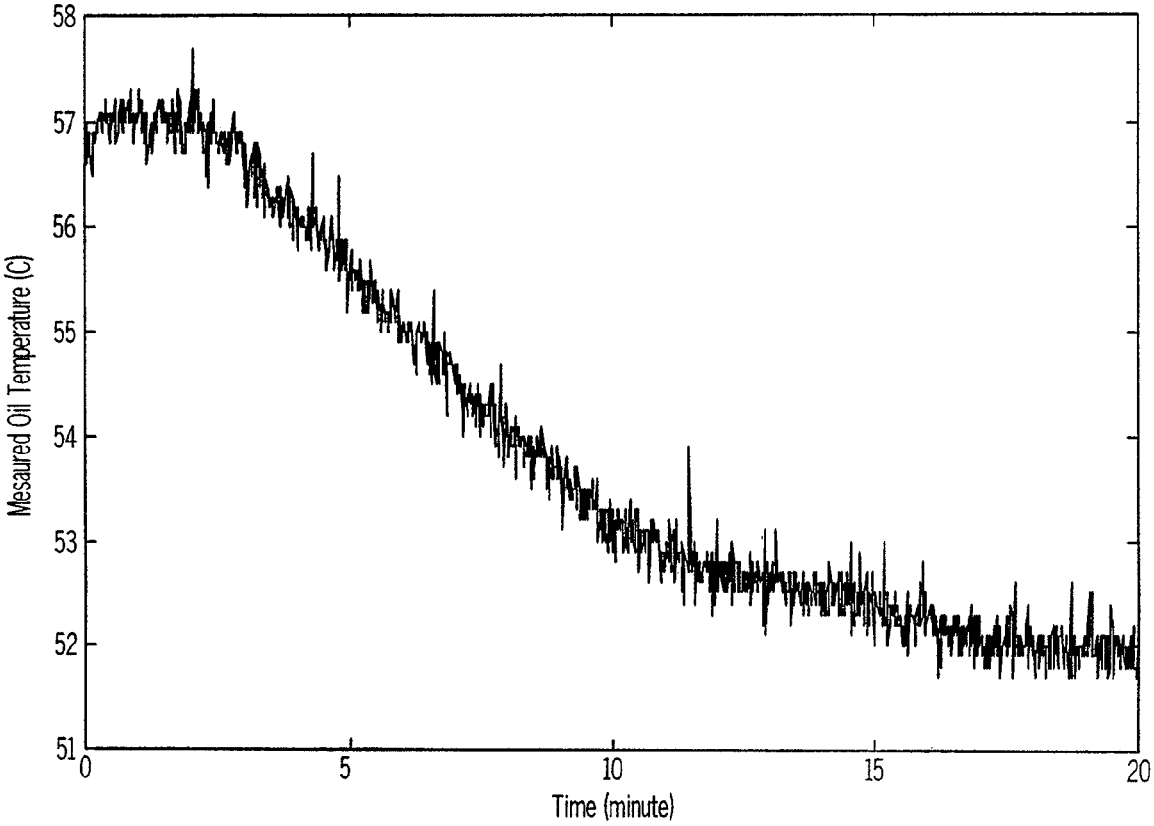
FIG. 11 contains a graph of the compressor oil temperature profile over time for the experiment.
Figure 12:
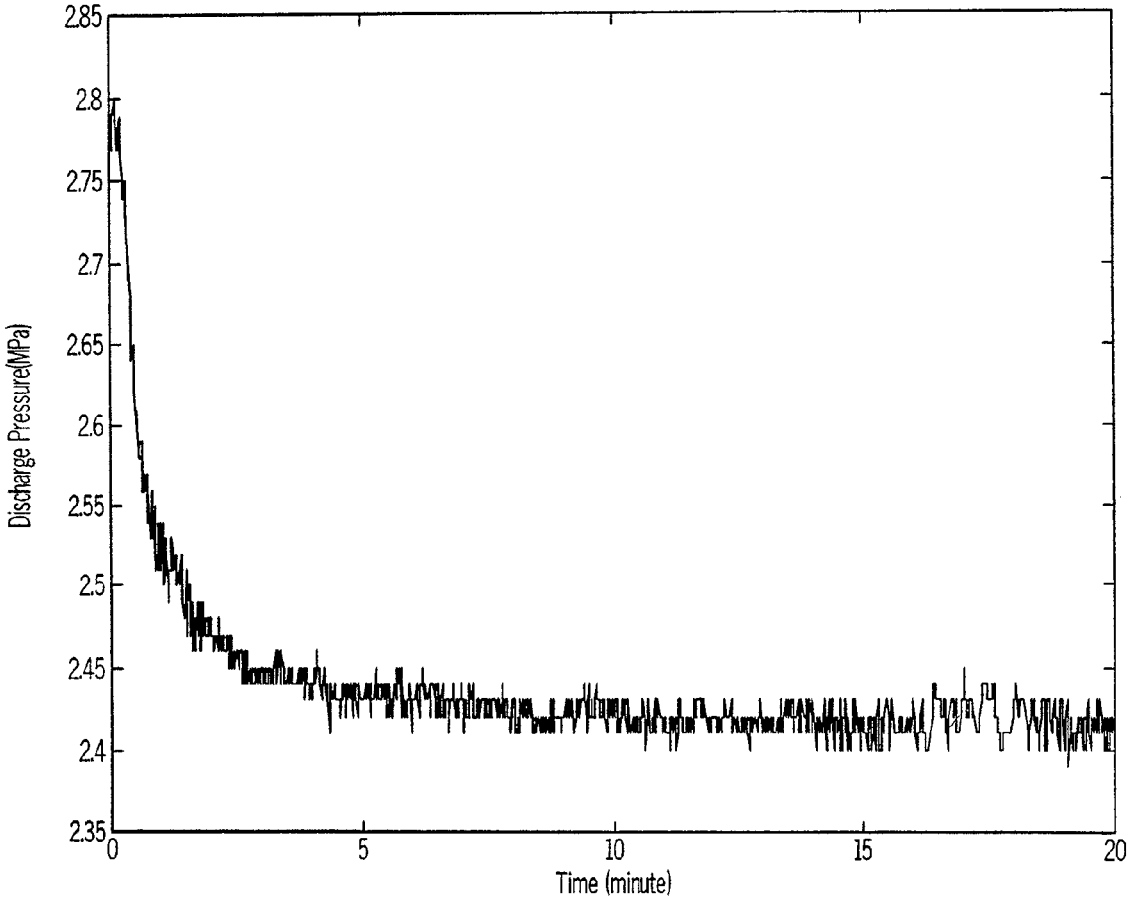
FIG. 12 contains a graph of the discharge pressure profile over time for the experiment.
Figure 13:
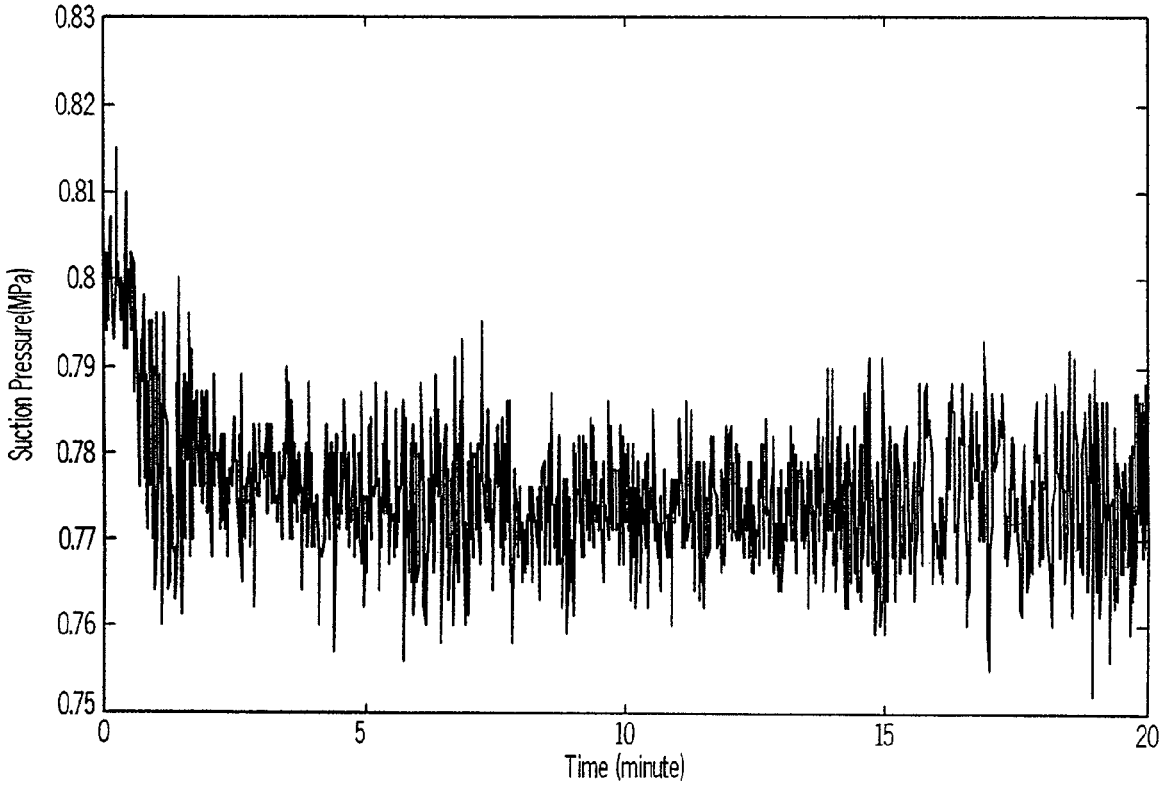
FIG. 13 contains a graph of the suction pressure profile over time for the experiment.
Figure 14:
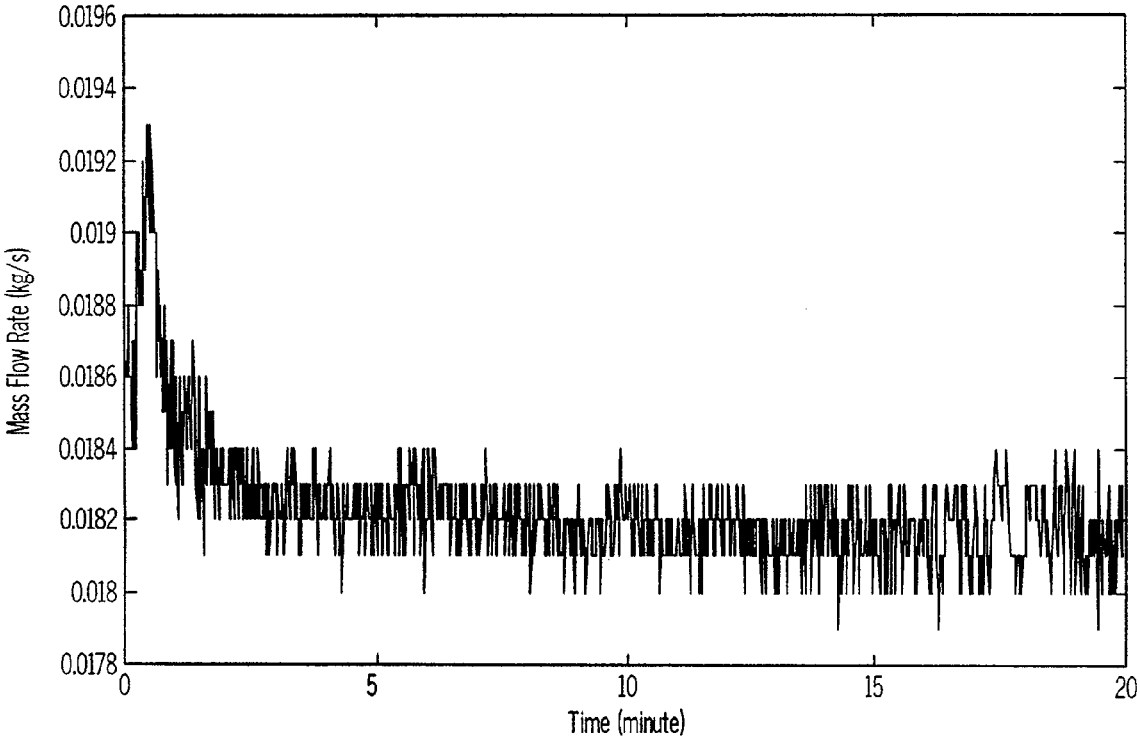
FIG. 14 contains a graph of the mass flow rate profile over time for the experiment.
Figure 15:
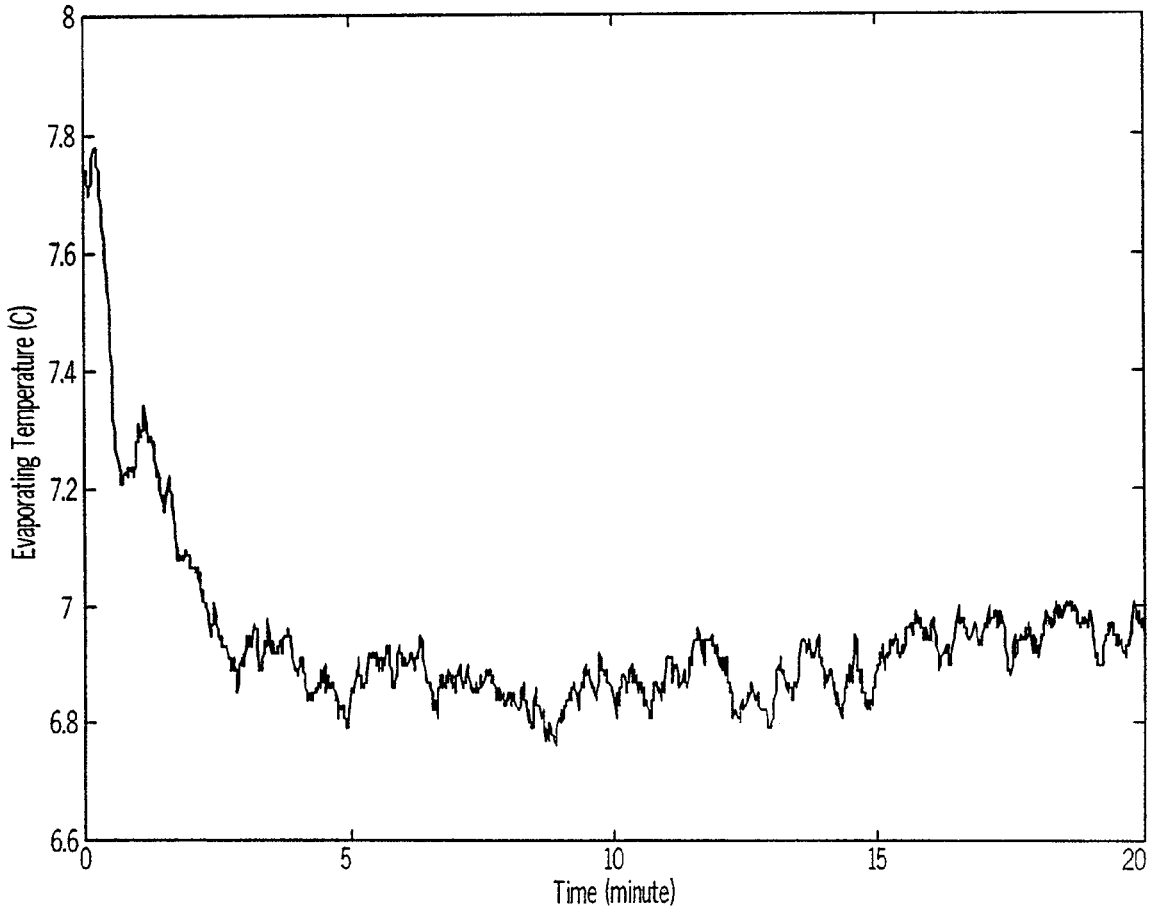
FIG. 15 contains a graph of the evaporating temperature profile over time for the experiment.
Figure 16:
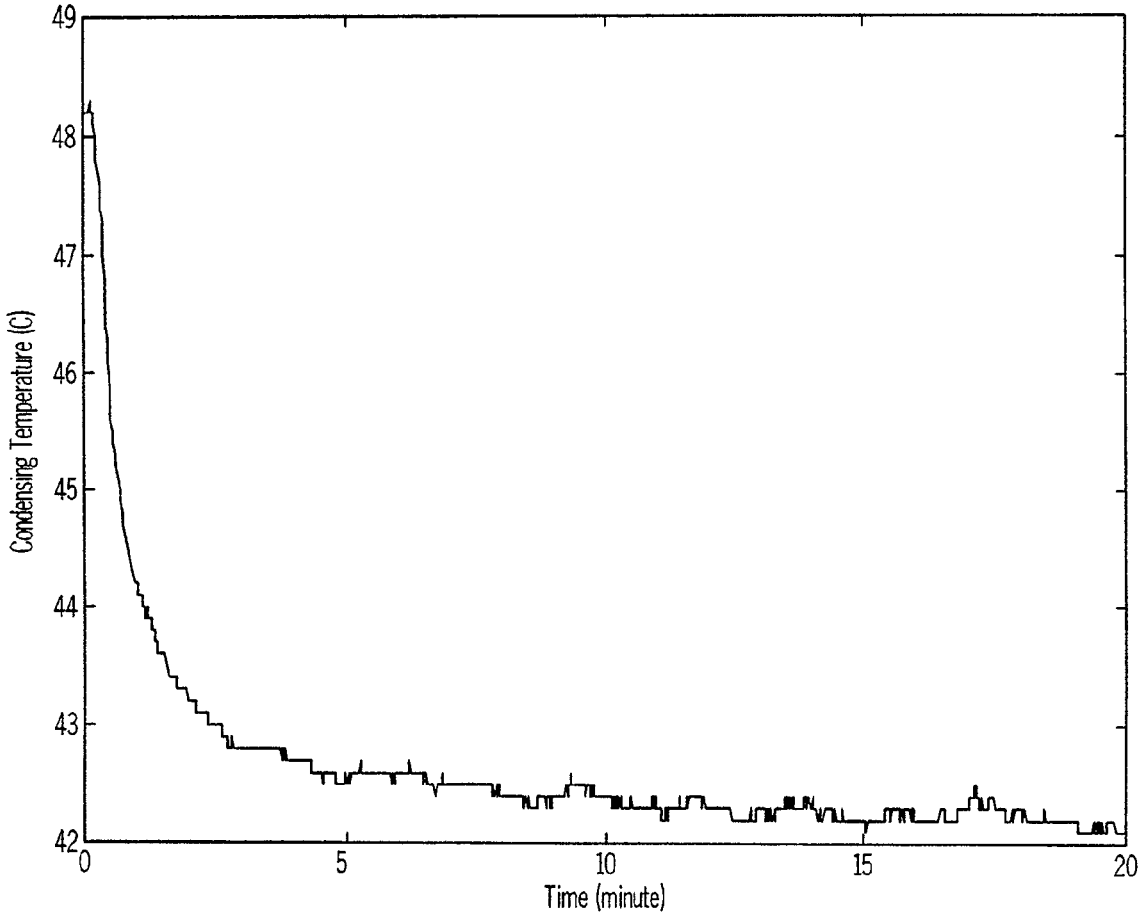
FIG. 16 contains a graph of the condensing temperature profile over time for the experiment.

FIG. 10 is a graph of the compressor oil viscosity profile over time for the experiment. FIG. 10 illustrates that the oil viscosity is changed from about 0.0035 Pa·s to 0.0039 Pa·s. FIG. 11 is a graph of the compressor oil temperature profile over time for the experiment. As shown in FIG. 11, oil temperature is changed from about 57 C to 52 C. FIG. 12 is a graph of the discharge pressure profile over time for the experiment. As shown in FIG. 12, discharge pressure is changed from 2.8 MPa to 2.4 MPa. FIG. 13 is a graph of the suction pressure profile over time for the experiment. FIG. 14 is a graph of the mass flow rate profile over time for the experiment. FIG. 15 is a graph of the evaporating temperature profile over time for the experiment. FIG. 16 is a graph of the condensing temperature profile over time for the experiment.

5.3 Comparison Results

The comparison between oil concentration estimated by the oil observer of the invention and experimental measurement of oil concentration by a viscosity sensor are set forth in this subsection. The first comparison is made under the initial condition.

Measurement at the Initial Condition:

1) Evaporating temperature: 7.8 C
2) Evaporating pressure: 0.8 MPa
3) Condensing temperature: 48.2 C
4) Condensing pressure: 2.77 MPa
5) Subcool: 6 C
6) Mass Flow Rate: 0.0185 kg/s
7) Oil Temperature: 57 C
8) Oil Viscosity: 0.0035 N/m^2*s (Pa*s)
9) Liquid Volume in Accumulator: 130 cc
10) Liquid Volume in Compressor: 330 cc Comparison 1) Estimation Error of Oil Concentration in Compressor=13%
2) Estimation Error of Oil Mass in Compressor: 10%

It is assumed that

1) Oil Circulation Rate in the Circuit is 0.5% (no sensor to measure)
2) Refrigerant Concentration in accumulator is 65% (no sensor to measure)

Figure 17:
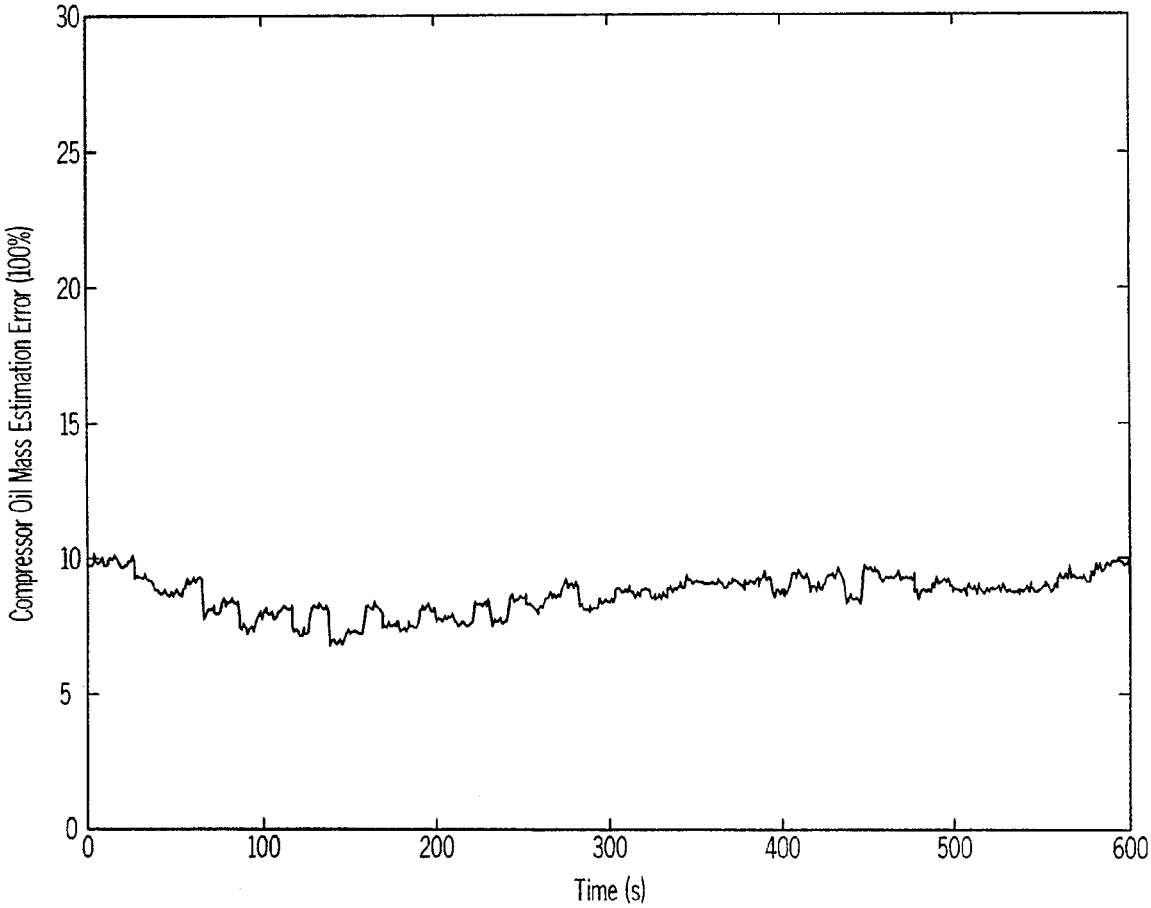
FIG. 17 contains a graph illustrating compressor oil mass estimation error in accordance with the invention.
Figure 18:
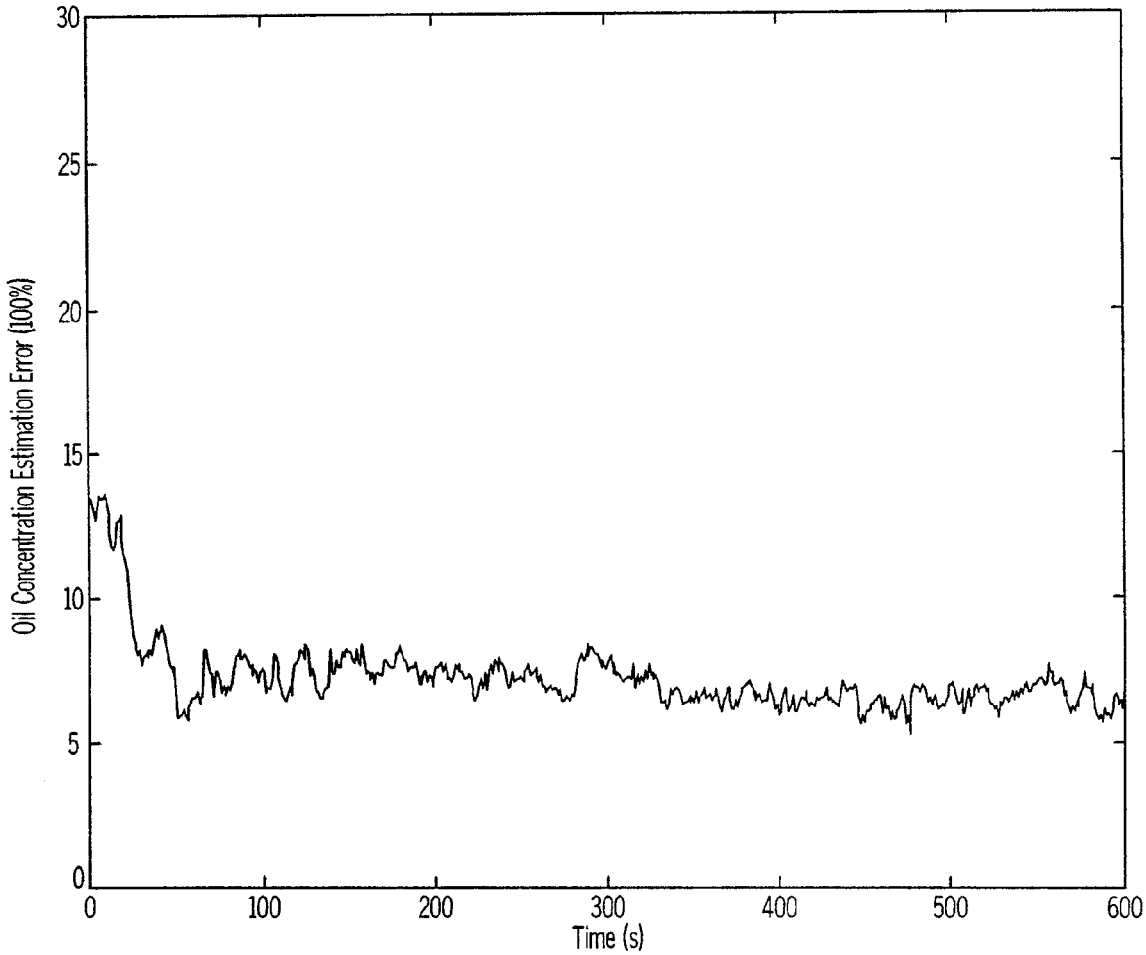
FIG. 18 contains a graph illustrating estimation error of oil concentration in the compressor in accordance with the invention.
Figure 19:
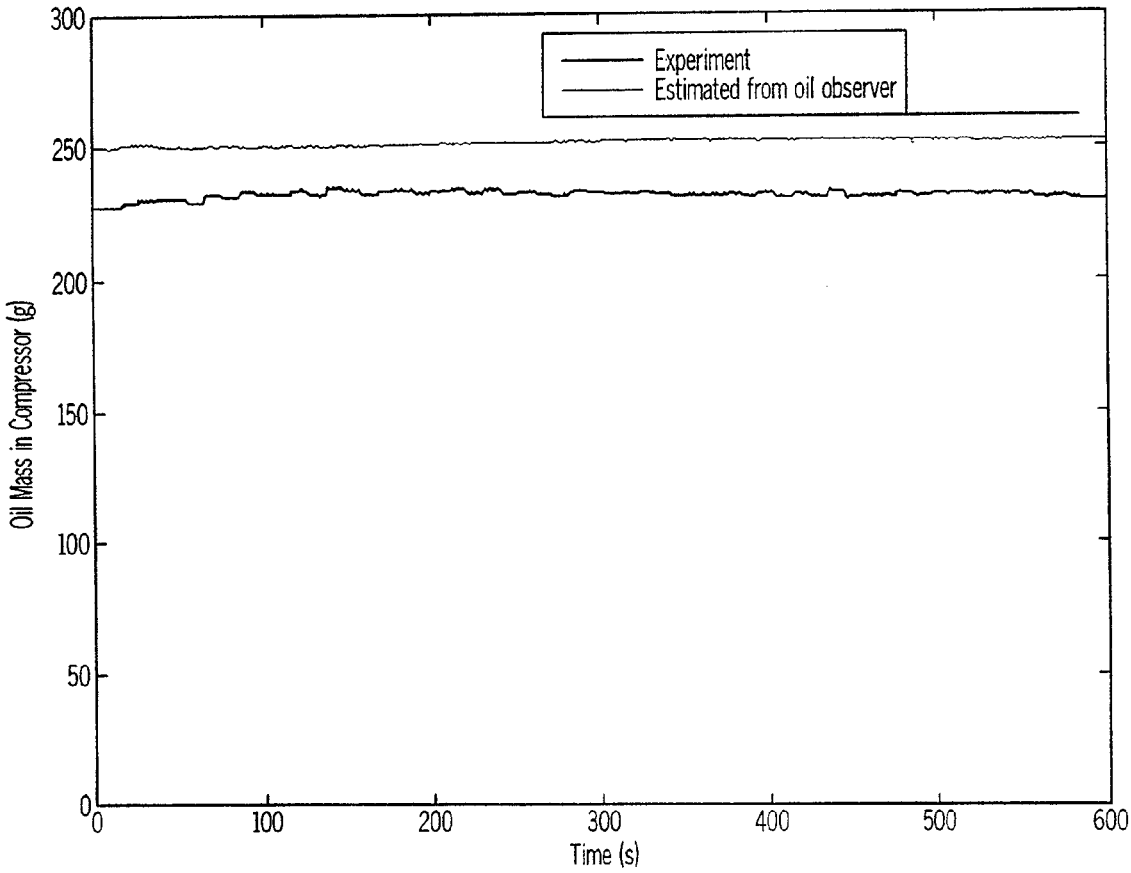
FIG. 19 contains a graph illustrating a comparison between experimental and estimated oil mass in the compressor in accordance with the invention.

For the dynamic conditions in which the outdoor temperature is changed from 35 C to 27 C described in subsection 5.2, the comparison results are shown in FIGS. 17-19. That is, FIG. 17 is a graph illustrating compressor oil mass estimation error. FIG. 18 is a graph illustrating estimation error of oil concentration in the compressor. FIG. 19 is a graph illustrating a comparison between experimental and estimated oil mass in the compressor in accordance with the invention. The estimation error is smaller than 10% in most cases.

Figure 20:
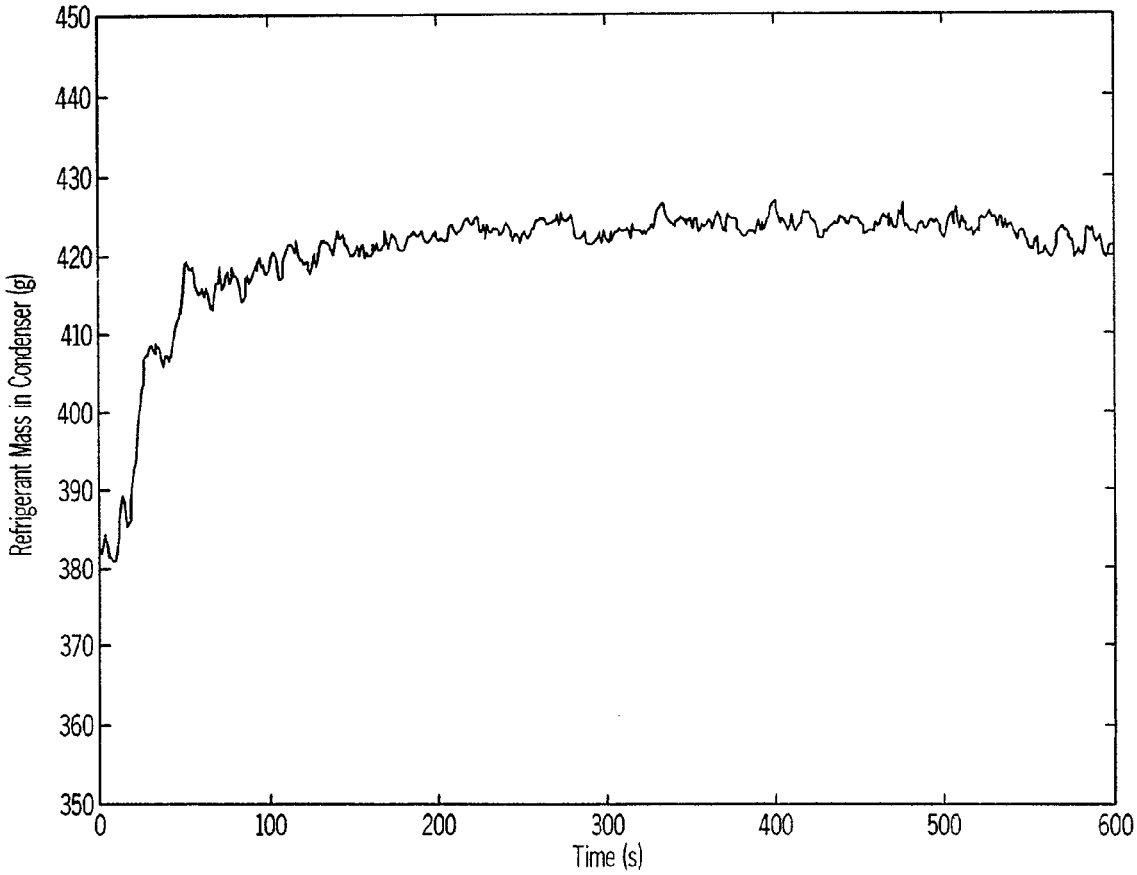
FIG. 20, contains a graph of refrigerant mass inventory in the condenser in accordance with the invention.
Figure 21:
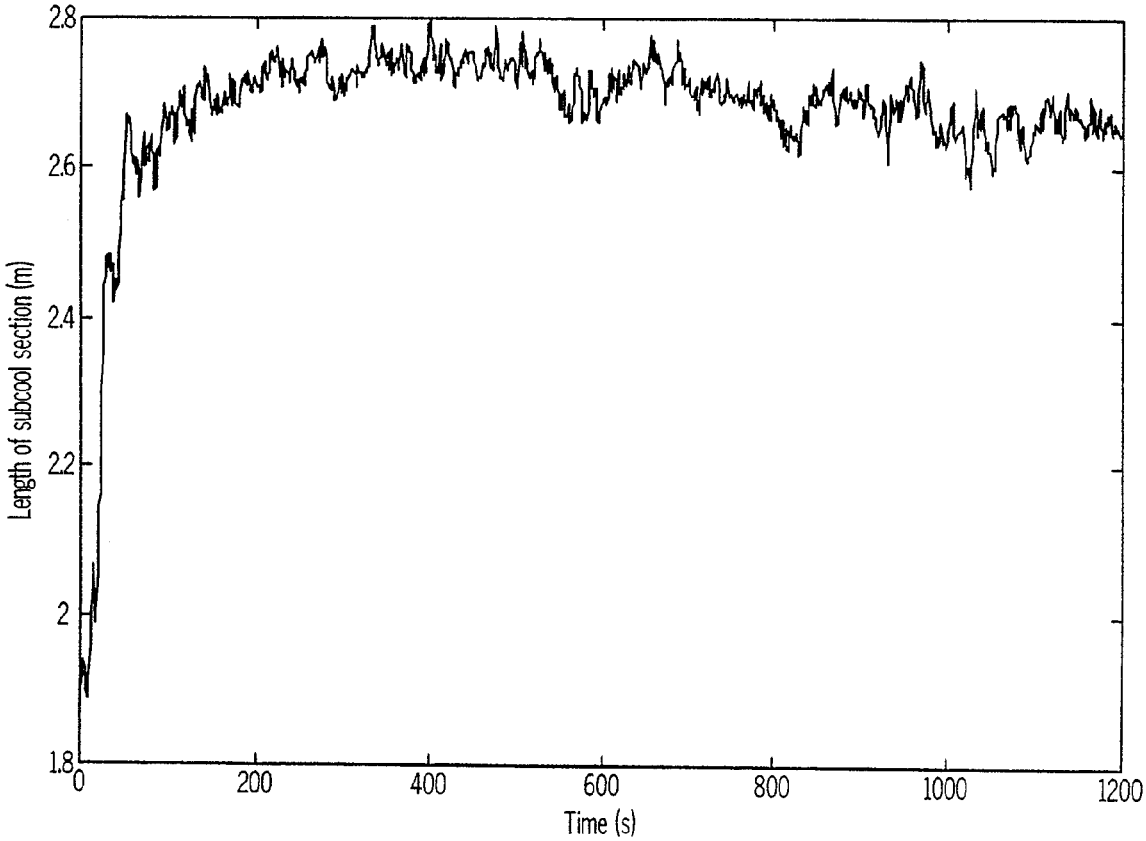
FIG. 21 contains a graph of condenser subcool section length for one pass in accordance with the invention.

During this dynamic process, the refrigerant mass in the condenser is changed from 380 g (42.2% of total refrigerant mass) to 420 g (46.7% of total refrigerant mass), as shown in FIG. 20, which is a graph of refrigerant mass inventory in the condenser for the experiment. FIG. 21 is a graph of condenser subcool section length for one pass in the experiment. The length of the subcool section Lc3 estimated from the condenser observer is shown in FIG. 21.

Figure 22:
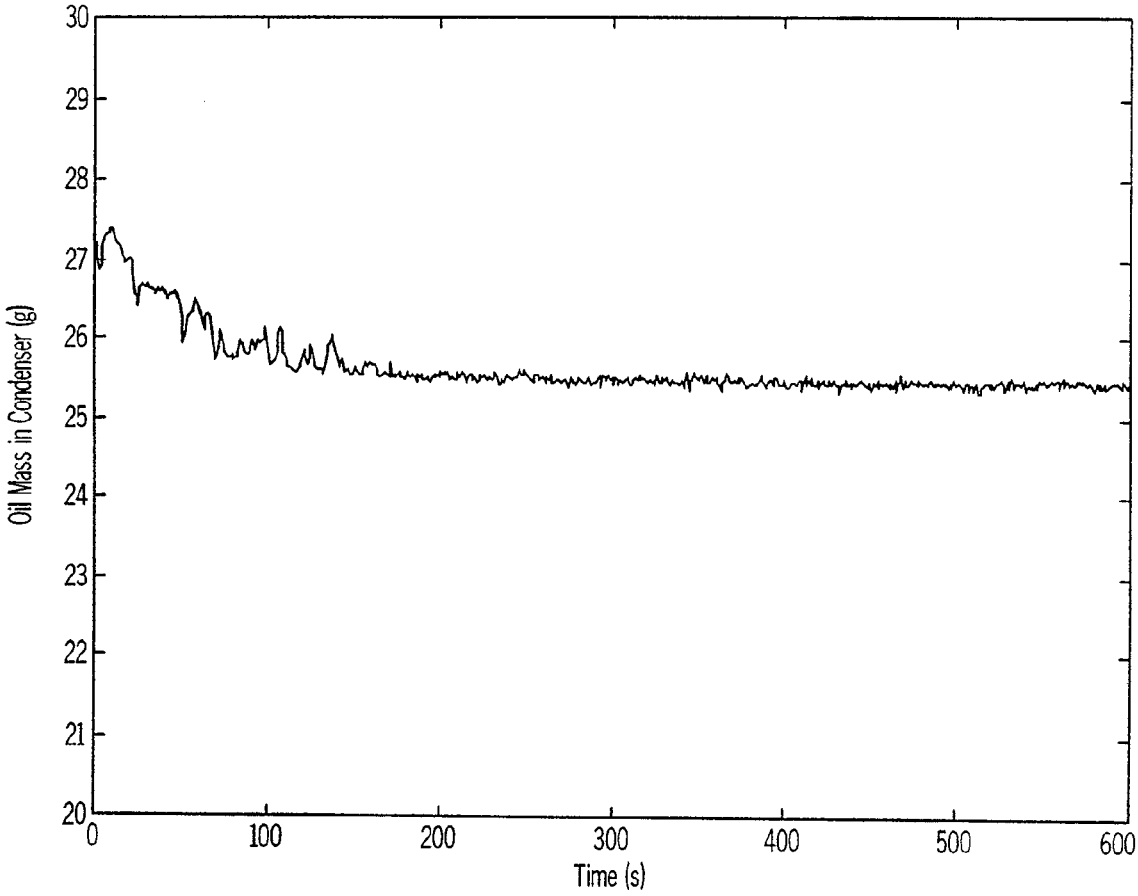
FIG. 22 contains a graph of the oil mass in the condenser in accordance with the invention.

FIG. 22 is a graph of the oil mass in the condenser for the experiment. With the subcool section length being changed from 1.9 m to 2.62 m, the refrigerant mass inventory is increased from 42.2% of total refrigerant mass to 46.7% of total refrigerant mass.

Table 1 shows the estimated oil distribution in the air conditioning machine at time t=10 minutes in accordance with the invention.

TABLE 1

Estimated Oil Mass in Each Component

| Component | % of Total Oil Mass |
|---|---|
| Compressor | 68.2% |
| Condenser | 5.6% |
| Evaporator | 2.8% |
| Gas Line (Suction) | 8.1% |
| Gas Line (Discharge) | 2.9% |
| Accumulator | 12.3% |
| Liquid Line | 0.1% |
| Total | 100% |

Table 2 shows the estimated refrigerant mass distribution in the air conditioning machine at time t=10 minutes.

TABLE 2

Estimated Refrigerant Mass in Each Component

| Component | % of Total Refrigerant Mass |
|---|---|
| Compressor | 19.2% |
| Condenser | 46.8% |
| Evaporator | 14.7% |
| Gas Line (Suction) | 1.5% |
| Gas Line (Discharge) | 2% |
| Accumulator | 11.7% |
| Liquid Line | 4.1% |
| Total | 100% |

Hence, the present invention includes a system-level oil observer to estimate oil concentration and oil mass in the compressor of a vapor compression system. The invention includes oil distribution and refrigerant distribution models for the condenser, evaporator, gas line, and liquid line to estimate oil mass and refrigerant mass in each component. Heat exchanger observers (for evaporator and condenser) and oil models are integrated into the compressor dynamic oil observer. Experimental testing was performed to validate the oil observer and develop comparison results that illustrate less than 10% error.

While this invention has been particularly shown and described with reference to preferred embodiments thereof, it will be understood by those skilled in the art that various changes in form and details may be made therein without departing from the spirit and scope of the invention as defined by the appended claims.

The invention claimed is:

1. A refrigeration apparatus comprising a device for monitoring a parameter related to lubricant in a first component of the refrigeration apparatus, the device estimating a first parameter which indicates a first amount of retained lubricant in a first other component of the refrigeration apparatus using a dynamic, non-linear observer model to generate an estimated first parameter, estimating a second parameter which indicates a second amount of retained lubricant in a second other component of the refrigeration apparatus to generate an estimated second parameter, summing the estimated first parameter and the estimated second parameter to generate a summed estimated parameter, and subtracting the summed estimated parameter from a parameter related to a known total lubricant in the refrigeration apparatus to generate a difference parameter, the difference parameter indicating an amount of lubricant retained in the first component of the refrigeration apparatus.

2. The refrigeration apparatus of claim 1, wherein the first component of the refrigeration apparatus is a compressor.

3. The refrigeration apparatus of claim 1, wherein the first other component of the vapor compression cycle system comprises one of an evaporator, an accumulator, a suction gas line, a discharge gas line, a condenser, a liquid line and a receiver.

4. The refrigeration apparatus of claim 1, wherein the first and second parameters which indicate an amount of retained lubricant in the first and second other components of the vapor compression cycle system are determined using one or more parameters related to the state of each component of the vapor compression system.

5. A method of monitoring a parameter related to lubricant in a first component of a vapor compression cycle system, comprising:

estimating a first parameter which indicates a first amount of retained lubricant in a first other component of the vapor compression cycle system using a dynamic, non-linear observer model to generate an estimated first parameter;

estimating a second parameter which indicates a second amount of retained lubricant in a second other component of the vapor compression cycle system to generate an estimated second parameter;

summing the estimated first parameter and the estimated second parameter to generate a summed estimated parameter; and subtracting the summed estimated parameter from a parameter related to a known total lubricant in the vapor compression cycle system to generate a difference parameter, the difference parameter indicating an amount of lubricant retained in the first component of the vapor compression cycle system.

6. The method of claim 5, wherein the first component of the vapor compression cycle system is a compressor.

7. The method of claim 5, wherein the first other component of the vapor compression cycle system comprises one of an evaporator, an accumulator, a suction gas line, a discharge gas line, a condenser, a liquid line and a receiver.

8. The method of claim 5, wherein the first and second parameters which indicate an amount of retained lubricant in the first and second other components of the vapor compression cycle system are determined using one or more parameters related to the state of each component of the vapor compression system.

* * * * *